US005482218A

United States Patent [19]

Ha

[11] Patent Number: 5,482,218

[45] Date of Patent: Jan. 9, 1996

[54] ROCK CRUSHING APPARATUS AND METHOD

[76] Inventor: Yonggan Ha, 11318 - 159B Street, Surrey, British Columbia, Canada, V3R 0K6

[21] Appl. No.: 187,036

[22] Filed: Jan. 27, 1994

[30] Foreign Application Priority Data

Oct. 20, 1993 [KR] Rep. of Korea ..... 21813

[51] Int. Cl.[6] ..... B02C 25/00; B02C 4/32

[52] U.S. Cl. ..... 241/30; 241/37; 241/140; 241/97; 241/204; 241/239; 241/285.3; 241/288

[58] Field of Search ..... 241/30, 32, 37, 241/140, 156, 203, 204, 239, 240, 241, 285.2, 285.3, 286, 287, 288, 290

[56] References Cited

U.S. PATENT DOCUMENTS

| | | | |
|---|---|---|---|
| 1,352,609 | 9/1920 | Kendall | 241/294 X |
| 1,946,763 | 2/1934 | Sallwasser | 241/140 X |
| 2,582,734 | 1/1952 | Adams | 241/156 X |
| 3,229,922 | 1/1966 | Weiss et al. | 241/204 |
| 3,503,563 | 3/1970 | Daly | 241/204 |
| 3,508,716 | 4/1970 | Daly | 241/204 |
| 3,716,196 | 2/1973 | Motek et al. | 241/37 X |
| 4,084,752 | 4/1978 | Hagiwara et al. | 241/37 X |
| 4,165,042 | 8/1979 | Peterson | 241/204 |
| 4,288,039 | 9/1981 | Waskow | 241/198 |
| 4,867,382 | 9/1989 | Manschwetus | 241/285.3 X |
| 5,125,585 | 6/1992 | Williams | 241/287 X |
| 5,255,869 | 10/1993 | Smith | 241/288 X |

FOREIGN PATENT DOCUMENTS

| | | | |
|---|---|---|---|
| 3524975 | 5/1988 | Japan . | |
| 1080852 | 3/1984 | U.S.S.R. | 241/32 |

*Primary Examiner*—Timothy V. Eley
*Attorney, Agent, or Firm*—Bull, Housser & Tupper

[57] ABSTRACT

The invention provides an apparatus for crushing material such as rock and includes a support structure having an inlet and an outlet. A powered rotor shaft rotates with respect to the support structure about a shaft axis, and a rotor mounted eccentrically on shaft describes orbital motion about the shaft axis. The rotor has a rotor wall which moves cyclically and laterally with respect to the axis during the orbital motion. At least one stator is mounted in the support structure to provide a stator wall spaced oppositely from the rotor wall to define therewith opposing walls of a crushing chamber located between the inlet and outlet. Feed direction of material passing between the inlet and outlet is generally perpendicular to the shaft axis, and when the rotor describes the orbital motion, spacing between opposing walls of the chamber varies cyclically. The stator is mounted yieldably so as to move away from the rotor when a pre-determined threshold force is exceeded so as to reduce possible damage. The invention provides a relatively wide crushing ratio and can accept relatively large rocks to reduce them to a relatively fine gravel. The invention generates an essentially continuous crushing action with relatively uniform crushing forces and is dynamically balanced to permit high speed operation to perform "multi-layer" crushing.

35 Claims, 16 Drawing Sheets

ROCK CRUSHING APPARATUS AND METHOD

BACKGROUND OF THE INVENTION

The invention relates to rock crushers as used in mines or in aggregate producing industries.

Prior art rock crushers can be classified into two main types, namely impact crushers and compression crushers. Impact crushers include hammer crushers, rotor impactors, vertical centrifugal impact crushers and cage mill crushers. Compression crushers include jaw crushers, gyratory crushers, cone crushers, roll crushers and pan crushers. Each type of crusher has one or more advantages for particular applications, and correspondingly, each type of crusher also has disadvantages which make them inappropriate for certain applications. The selection of a particular type of crusher is usually dependent on the material to be crushed and the final application of the crushed material, as well as cost and maintenance considerations.

Impact crushers have rotating impact parts which wear rapidly, are not very successful in crushing very hard minerals or ordinary rocks, and cannot easily handle large sized material over 1 meter. Also, considerable power is consumed in the impacting process, and vibration is severe.

Some compression crushers have similar problems to impact crushers, for example roll crushers are prone to rapid wear, and once a portion of a roll is worn, rate of wear of that portion increases as material to be crushed tends to be concentrated on the worn portion of the roll. Also, roll crushers cannot handle large sized material, and are usually limited to material less than 0.2 meters. While jaw crushers can handle material larger than 1 meter, they have a relatively low efficiency with respect to time as they cannot be operated at high speed due to severe vibration of moving jaw parts which tend to follow complicated movements. The complicated movements of the jaw parts causes severe balancing problems, and because complete balancing is essentially impossible, the machines are operated at a relatively low speed to avoid excessive vibration. In addition, operation of a jaw crusher can be divided into two periods, namely a compression period and a releasing period. During the compression period, most of the material between the jaws is crushed at the same time, and this requires relatively high forces which are generated for a relatively short period of time by an eccentric shaft and bearings. During the releasing period, no effective work is being performed, and this reduces overall operating productivity with respect to time.

Cone crushers have a relatively high efficiency with respect to time when crushing small size material, which is preferably less than 0.15 meter but with special design the cone crusher can handle material up to 0.4 meters. Gyratory crushers have similar characteristics to cone crushers, but in general can handle larger material than the cone to crusher, i.e. material up to 1.5 meters. However, a gyratory crusher that can handle the same large size material as a jaw crusher is very much larger than the jaw crusher, and is correspondingly far more costly. A major advantage of both the cone crusher and the gyratory crusher is that material is crushed continuously between a rotor and stator, and thus application of forces on bearings and other portions is essentially continuous and relatively moderate. Thus, cone crushers and gyratory crushers can operate more efficiently with respect to time by applying essentially continuous and relatively moderate forces to the material than when compared with the relatively high forces, applied for short time intervals, that occurs with jaw crushers. However, cone crushers and gyratory crushers are more complicated and costly than jaw crushers, and usually cannot handle the relatively large material handled by jaw crushers.

In all rock crushers known to the inventor, many factors must be considered when selecting a crusher for a particular application. For example, the ratio of average size of raw material at the inlet, to average size of finished product at the outlet is referred to as "reduction ratio", and if only one machine is to used on a site, the reduction ratio for that one machine is generally larger than the reduction ratio of individual machines if several machines are to be used in series with each other on a site. Also, a limiting factor in most crushing operations is determined by maximum size of primary material that is fed into the primary crusher at the site and maximum "sliding angle" of the inlet as will be described with reference to FIG. 19.

SUMMARY OF THE INVENTION

The invention reduces the difficulties and disadvantages of the prior art by providing an apparatus and method for crushing material which generates an essentially continuous crushing operation which reduces energy consumption, wear and vibration, and yet maintains high productivity with respect to time when compared with prior art crushers. The present invention enables an essentially continuous application of force to material to be crushed, thus reducing short period, high crushing forces that can occur with a jaw crusher, while maintaining the high productivity found with a gyratory crusher or a cone crusher. However, in contrast with the gyratory crusher, the present invention can also handle relatively large material, i.e. material of 2 meters or more. Also in contrast with the gyratory crusher or cone crusher, an apparatus according to the invention that can handle relatively large material is considerably smaller than would be required for a conventional gyratory crusher or cone crusher. This reduction in size reduces costs considerably, as well as increasing versatility of the invention by also being able to handle relatively small material. Furthermore the present invention can be balanced easily and effectively, and balance can be easily adjusted, and thus can be operated at relatively high speeds, further improving productivity with respect to time when compared with the prior art. The ability of operating the invention at relatively high speeds permits "multi-layer" crushing, which increases productivity and produces relatively small sized gravel of better shape and form. In addition, the present invention is mechanically relatively simple, and this reduces initial capital costs and, simplifies maintenance, thus reducing ongoing running costs and repairs.

An apparatus according to the invention is for crushing material and comprises a support means, a powered rotor shaft, a rotor and at least one stator. The support means has an inlet and an outlet to receive material to be crushed, and to discharge crushed material respectively. The powered rotor shaft is mounted for rotation with respect to the support means about a shaft axis. The rotor is mounted eccentrically on the shaft for orbital motion about the shaft axis. The rotor has a rotor wall which is parallel to the shaft axis when viewed laterally of the axis and which moves cyclically and laterally with respect to the axis when the rotor describes the orbital motion. The first stator is mounted in the support means and has a first stator wall spaced oppositely from the rotor wall and disposed parallel to the rotor wall when viewed laterally of the axis. The walls of the stator and rotor define opposing walls of a first crushing chamber located between the inlet and Outlet of the housing so that when the rotor is describing the orbital motion, spacing between the opposing walls varies cyclically.

The said walls of the first crushing chamber define in part a first feed direction of material passing through the crushing chamber from the inlet to the outlet. In some embodiments, the first feed direction is generally perpendicular to the shaft axis. The apparatus further comprises yieldable mounting means for permitting yielding movement of the stator wall with respect to the support means when the stator wall is subjected to a generally laterally inclined force greater than a pre-determined threshold force.

In other embodiments, the apparatus further comprises a second stator spaced on a side of the rotor remote from the first stator, so that the rotor is partially enclosed by the first and second stators. The second stator has a second stator wall spaced oppositely from the rotor wall to define therewith opposing walls of a second crushing chamber located between the inlet and outlet of the housing. The said walls of the second crushing chamber define in part a second feed direction of the material passing through the second crushing chamber from the inlet to the outlet. The support means comprises a support housing having first and second housing end walls spaced axially apart and extending between the first and second stators and a rotor shaft mounting means cooperates with the end walls to mount the rotor shaft for rotation relative to the housing.

A method according to the invention is for crushing material and comprises the steps of:

admitting the material into a crushing chamber, moving an eccentrically mounted rotor in an orbital motion about a shaft axis within the crushing chamber to provide a rotor wall which is disposed parallel to the shaft axis when viewed laterally of the axis and which moves cyclically and laterally with respect to the axis as the rotor describes the orbital motion, spacing a stator laterally from the rotor to provide oppositely facing rotor and stator walls which are parallel to each other when viewed laterally of the axis and which define in part walls of the crushing chamber so that when the rotor is moving, spacing between the opposing walls varies cyclically, and discharging crushed material from the crushing chamber.

Preferably, the method is further characterized by permitting the stator wall of the crushing chamber to move yieldably with respect to the shaft axis from a pre-determined position when subjected to a crushing force above a pre-determined threshold force. Also, preferably, the method is further characterized by automatically returning the stator wall to the pre-determined position subsequent to the stator wall yielding to the said crushing force.

A detailed disclosure following, related to drawings describes a preferred embodiment and alternatives of the invention which is capable of expression in apparatus and method other than those particularly described and illustrated.

DETAILED DESCRIPTION

FIG. 1

Figure 1:
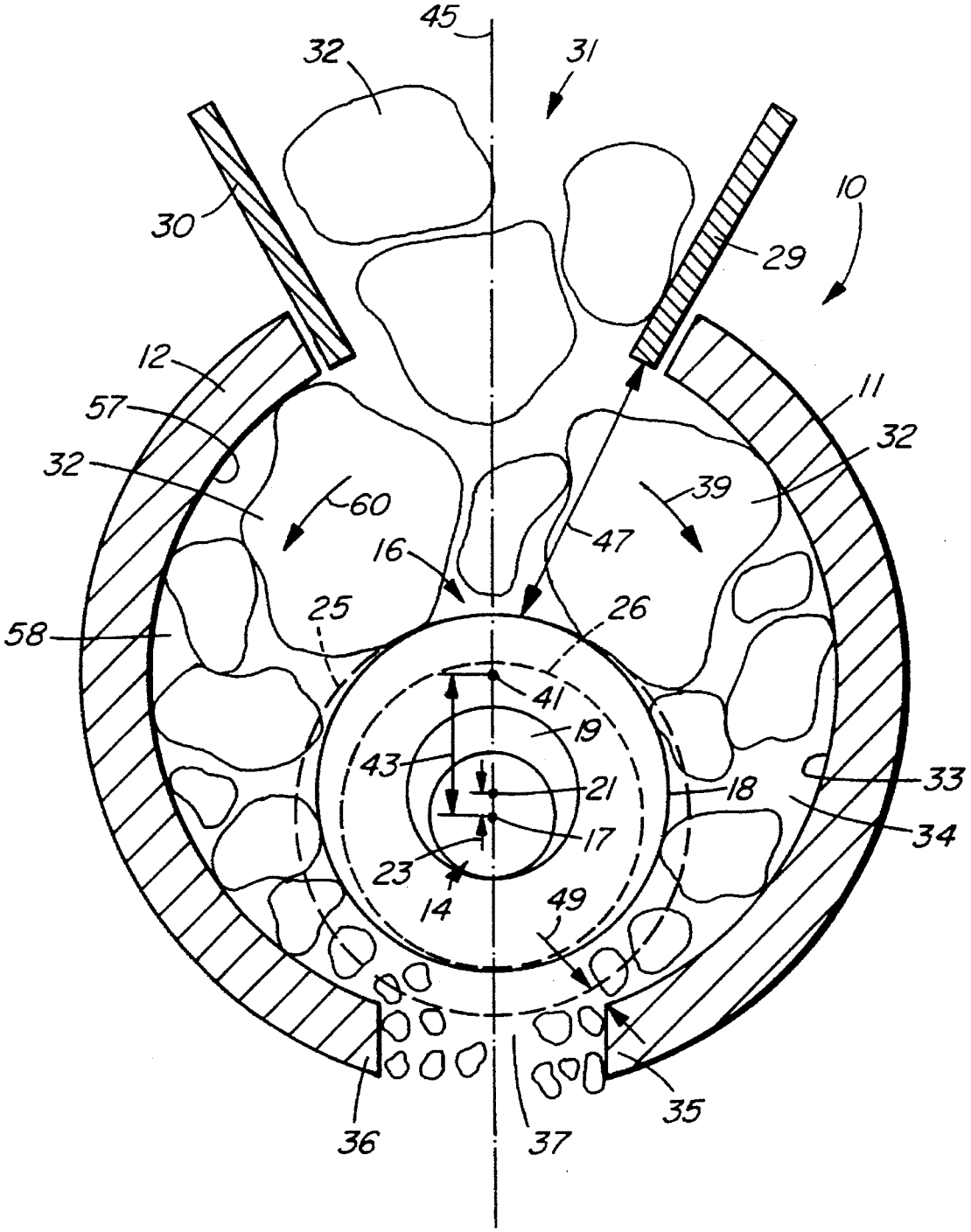
FIG. 1 is a simplified diagram of a symmetrical twin stator embodiment of a crushing apparatus according to the invention, the diagram representing a transverse section perpendicular to a rotor axis, miscellaneous supporting and operating structure being omitted for clarity.

A preferred embodiment of a crushing apparatus 10 according to the invention has essentially stationary first and second stators 11 and 12, and a powered rotor shaft 14 carrying an eccentric rotor 16 disposed between the stators. The stators and the rotor shaft are mounted in a support housing as will be described with reference to FIGS. 2–6. The powered rotor shaft is mounted for rotation with respect to the housing about a shaft axis 17, and the rotor 16, which has a cylindrical rotor wall 18, is mounted on the shaft eccentrically with respect to the axis 17 for orbital motion about the shaft axis. The rotor shaft 14 has an eccentric lobe 19 having a cylindrical surface centred on a lobe axis 21 disposed parallel to, but spaced laterally from, the shaft axis 17 at an eccentric spacing 23 (also shown in FIG. 6). The cylindrical rotor wall 18 is concentric with the lobe axis and thus the rotor 16 has the same eccentricity as the lobe 19. Thus, it can be seen that the rotor wall is disposed parallel to the shaft axis when viewed laterally of the axis and when the shaft 14 rotates and the rotor describes the orbital motion, the rotor wall 18 moves cyclically and laterally with respect to the shaft axis 17. A locus of an outermost portion of the rotor wall 18 is shown in broken outline at 25, and a locus of an innermost portion of the rotor wall is shown in broken outline at 26. Thus, two concentric broken outline circles 25 and 26 delineate outer and inner limits respectively of a volume swept by the rotor 16 as the rotor shaft rotates, which volume is independent of direction of rotation of the shaft.

Upper portions of the first and second stators 11 and 12 are located to cooperate with first and second hopper portions 29 and 30 respectively to receive material to be crushed. The first and second hopper portions are laterally spaced apart to define an inlet 31 of the apparatus to receive the rock material to be crushed, some portions of material being designated 32. Lower portions 35 and 36 of the stators 11 and 12 are spaced apart laterally to define an outlet 37 to pass crushed material from the apparatus. The first stator 11 has a first stator wall 33 spaced oppositely from the rotor wall 18 and disposed parallel to the rotor wall when viewed laterally of the axis 17 to define therewith opposing walls of a crushing chamber 34 located between the inlet 31 and the outlet 37. An arrow 39 defines feed direction of the material through the first chamber 34 from the inlet 31 to the outlet 37 as will be described. The first stator wall is at least partially cylindrical and is centred on a first stator axis 41 which is parallel to and spaced from the shaft axis 17 by a first axis spacing 43. The axis 41 is disposed within a radially aligned plane 45 of the shaft axis, and it can be seen that the eccentric spacing 23 is less than the first axis spacing 43, so that cross-sectional area of the crushing chamber 34 decreases in the feed direction. That is, a minimum radial spacing 47 adjacent the inlet 31 is greater than a minimum radial spacing 49 adjacent the outlet 37.

Similarly to the first stator, the second stator 12 has a second stator wall 57 spaced oppositely from the rotor wall 18 to define therewith opposing walls of a second crushing chamber 58 located between the inlet 31 and outlet 37 of the housing. The said walls of the second crushing chamber define in part a second feed direction, shown by an arrow 60, which is on an opposite side of the rotor as shown. Similarly to the first stator wall, the second stator wall is centred on the first stator axis 41, and thus has a radius of curvature essentially identical to that of the wall 33. Clearly when the cylindrical lobe of the rotor 16 is positioned symmetrically as shown, the second crushing chamber is essentially identical to the first crushing chamber, but is a mirror image thereof.

Figure 14:
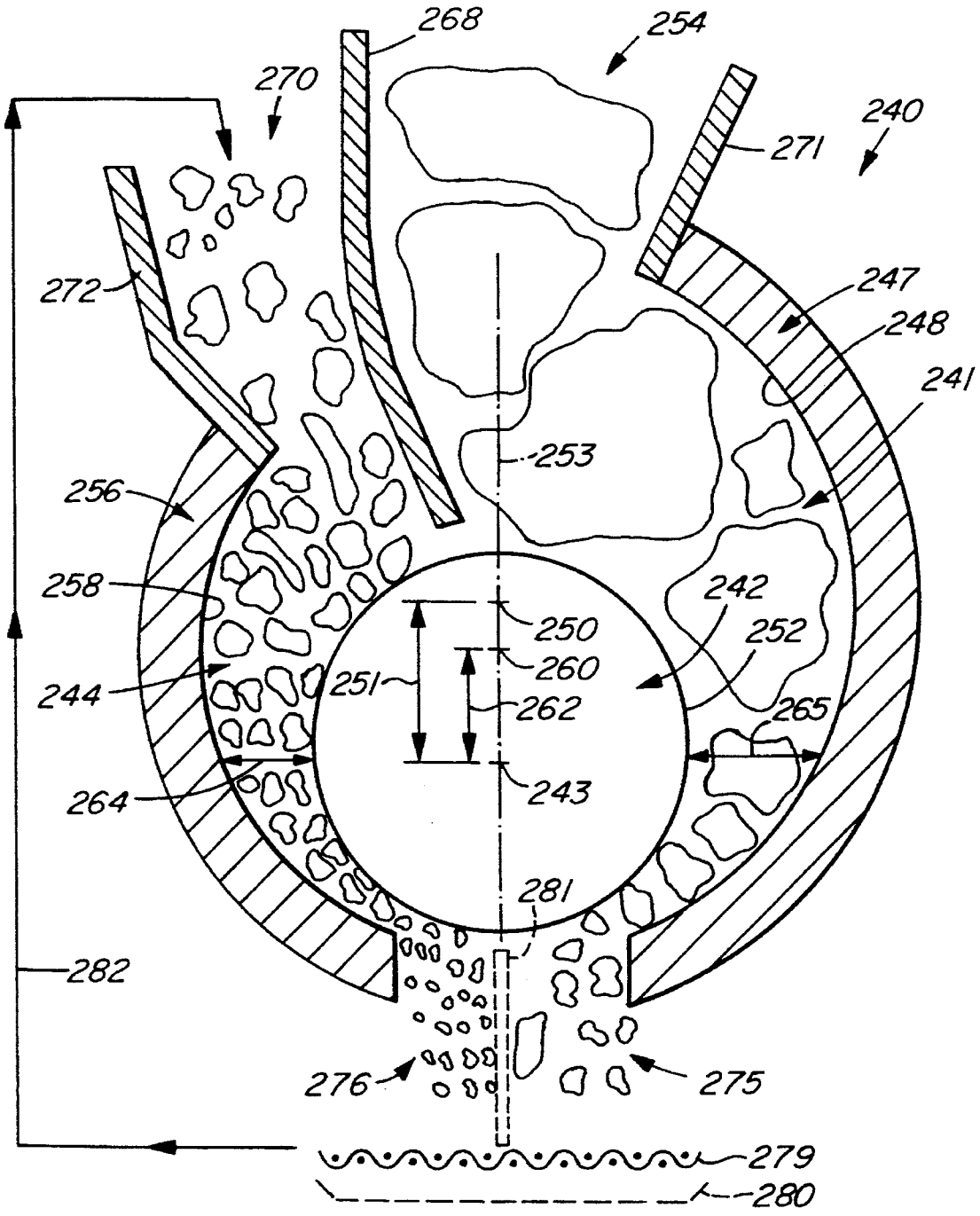
FIG. 14 is a simplified diagram, generally similar to FIG. 1, showing an alternative asymmetrical twin stator embodiment of a crushing apparatus, with conveyor options shown simplified.
Figure 15:
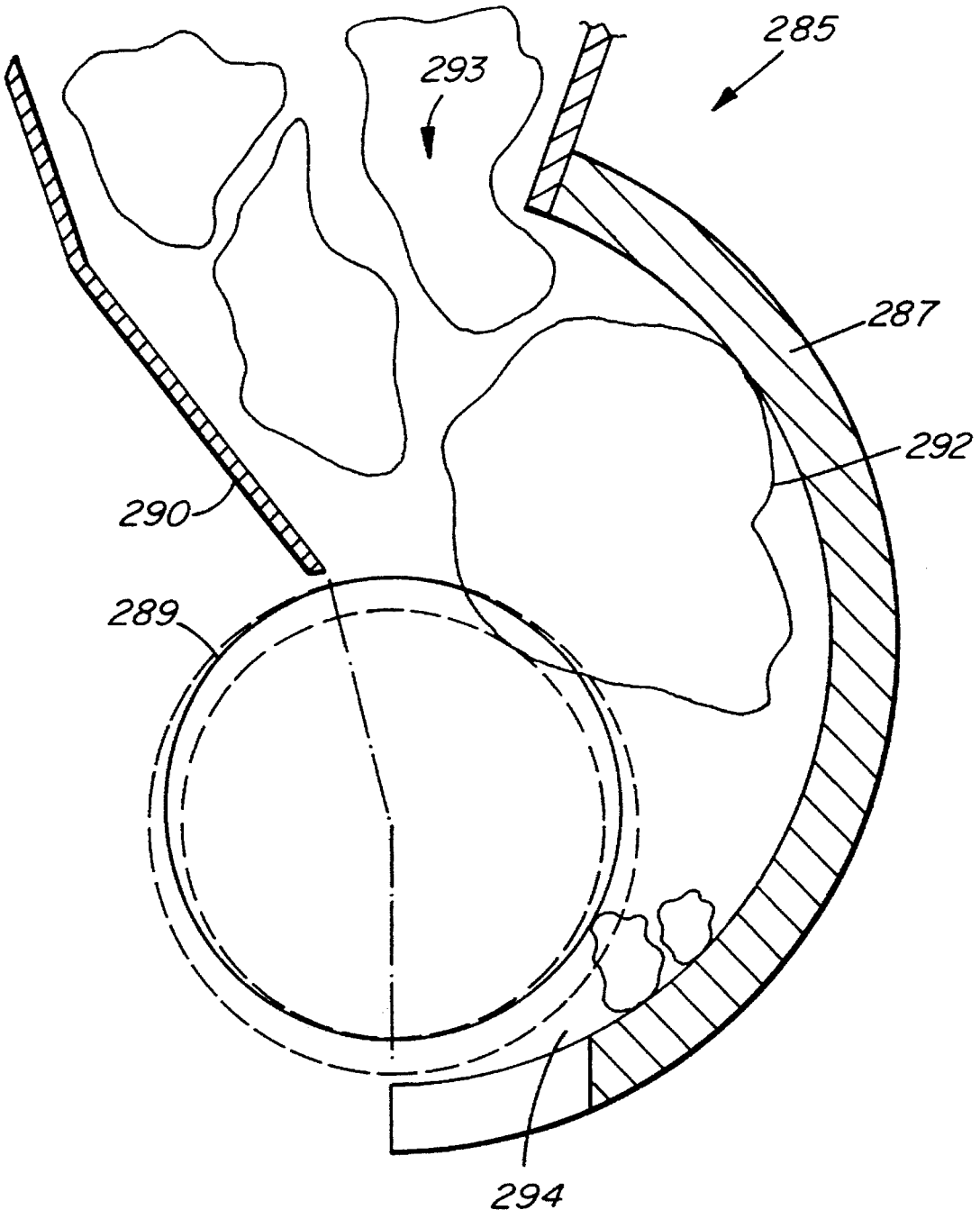
FIG. 15 is a simplified diagram generally similar to FIG. 1, showing an alternative asymmetrical, single stator embodiment of a crushing apparatus.

Thus, the preferred embodiment of the invention has two stators disposed symmetrically about the rotor, one being on a side of the rotor 16 remote from the other, so that the rotor is partially enclosed by the first and second stators. This embodiment has symmetrical stators and is appropriate when crushed material from each crushing chamber is to be of a generally uniform size. Alternative arrangements are to be described with reference to FIGS. 14 and 15 which disclose alternative asymmetrical twin stator and asymmetrical single stator arrangements respectively for different purposes.

FIGS. 2 through 6

Figure 2:
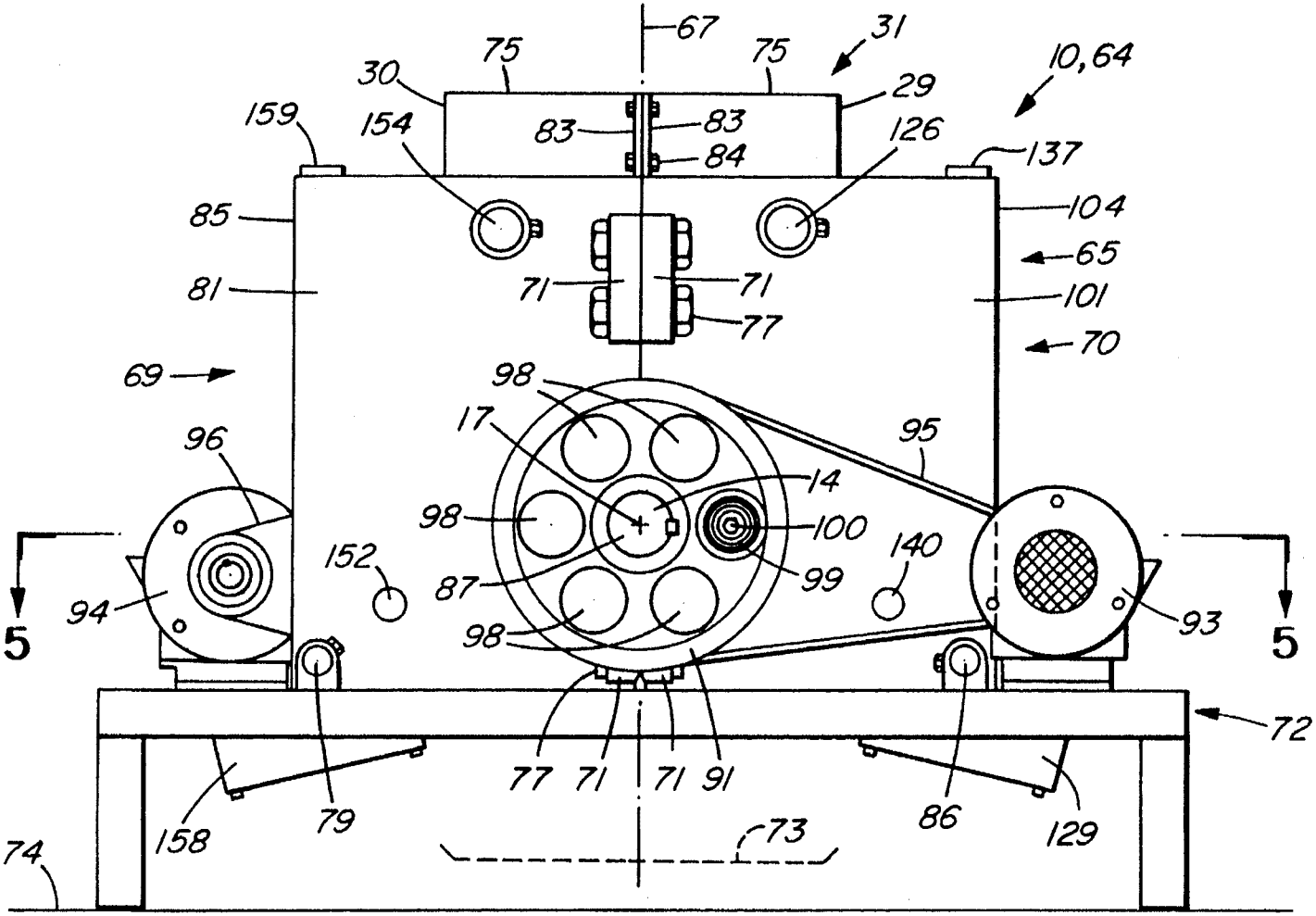
FIG. 2 is a simplified front view of the crushing apparatus according to the FIG. 1 embodiment.

As seen in FIG. 2, the crushing apparatus 10 has a support means 64 comprising a support housing 65 which is an essentially rectangular box having a main vertical axial plane 67 which contains the shaft axis 17 and divides the box into two generally equal portions, namely left hand and right hand housing portions 69 and 70. The portions 69 and 70 are carried on a support chassis 72 which is a portion of the support means 64 and has a generally horizontal upper surface to carry the housing portions 69 and 70 and related equipment. The chassis 72 is spaced from a lower supporting surface 74 to provide access under the apparatus for a conveyor 73 (broken outline) to remove crushed material from the apparatus, and for servicing the apparatus etc. The portions 69 and 70 are held together by flanges 71, and cooperating nuts and bolts, designated generally 77, which straddle the axial plane 67.

Figure 3:
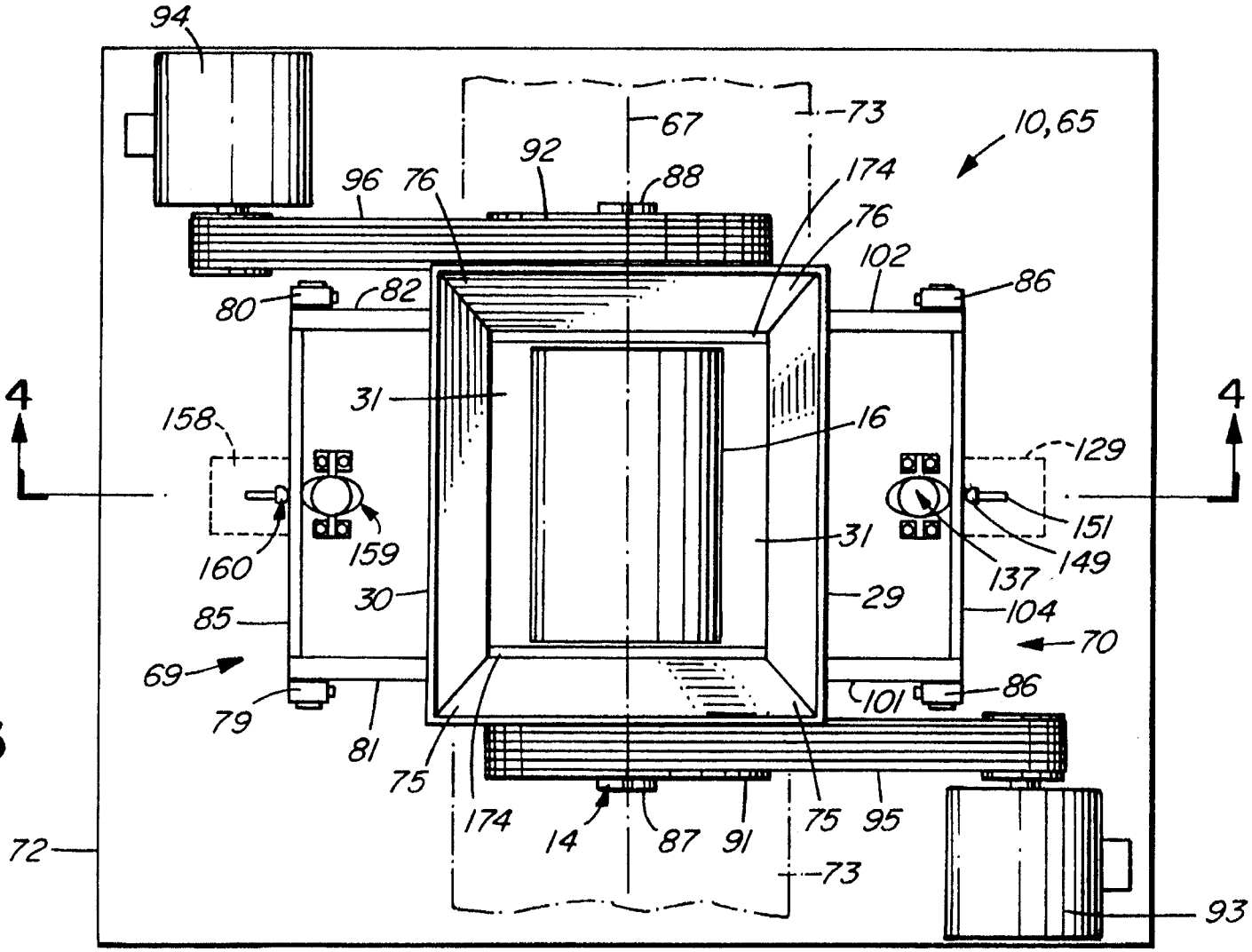
FIG. 3 is a simplified fragmented top plan of FIG. 2.
Figure 7:
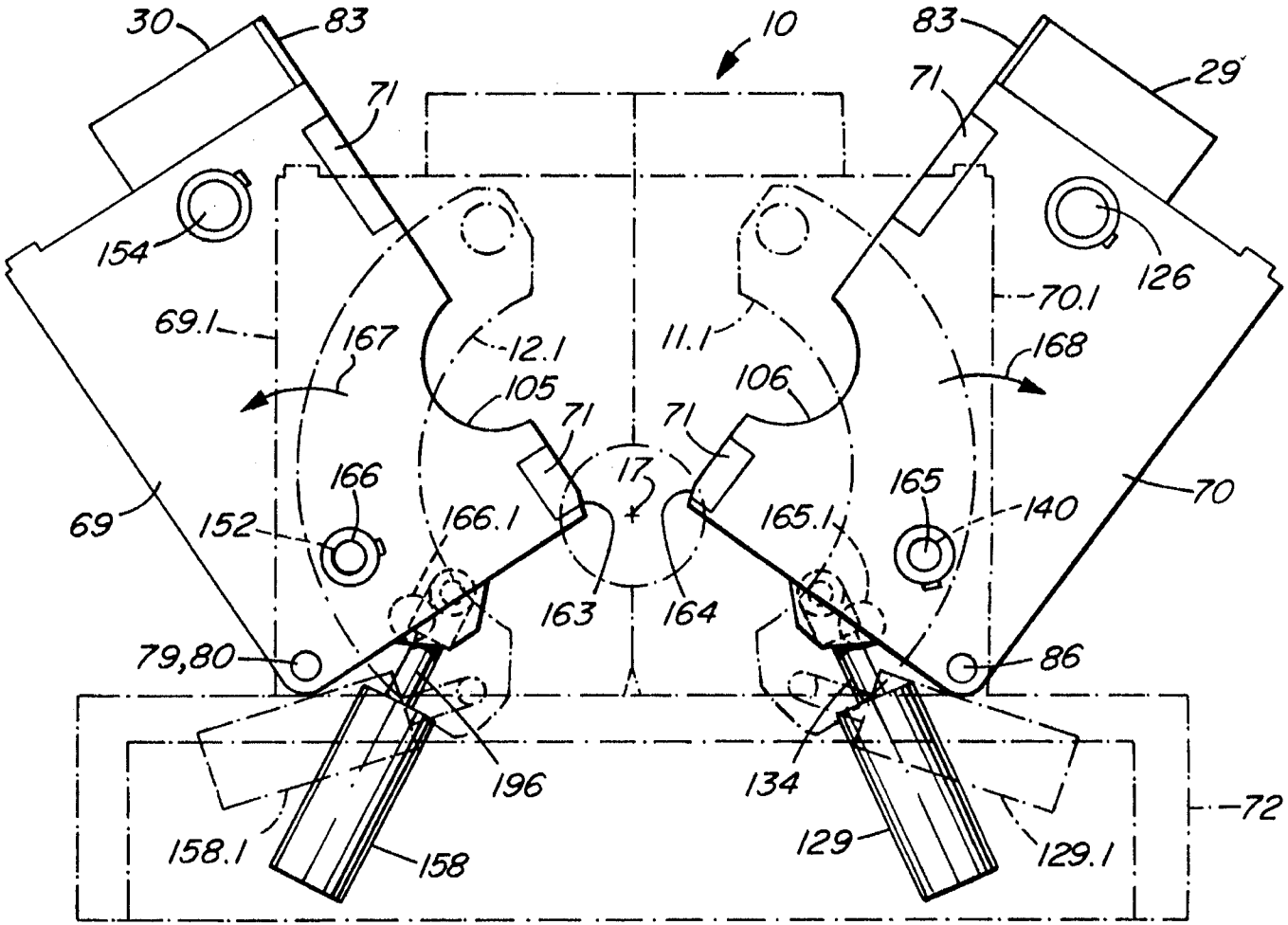
FIG. 7 is a simplified diagram of a front view of the crusher, generally similar to that shown in FIG. 2, but with portions removed for clarity and showing rotation of support housing portions to provide access to the rotor and stator for servicing.

As best seen in FIGS. 2 and 3, the portions 69 and 70 are generally similar, and thus only the portion 69 will be described in detail. The portion 69 has generally parallel, axially spaced apart first and second end walls 81 and 82 interconnected by a side wall 85 disposed perpendicularly thereto and also extending between the stator. The first and second end walls 81 and 82 cooperate with first and second hinge assemblies 79 and 80 respectively which permit limited hinging movement of the first housing portion with respect to the chassis 72 for reasons to be described with reference to FIG. 7. The right hand portion 70 of the support housing 65 has similar first and second end walls 101 and 102, which are co-planar with the corresponding end walls 81 and 82 respectively, and a similar side wall 104 parallel to the wall 85. Hinge assemblies 86 hinge each end wall 101 and 102 to the chassis 72 similarly to assemblies 79 and 80. Thus, it can be seen that each housing end wall can be split into two separable end wall portions respectively to permit separation of at least one separable end wall portion from the rotor shaft mounting means, the separable end wall portion being hinged for rotation about a respective housing hinge relative to the support means. The hopper portions 29 and 30 extend between aligned pairs of opposing hopper wall portions 75 and 76, which in turn are located above aligned end walls 81 and 101, and 82 and 102 respectively, to guide material into the apparatus. Each aligned pair of hopper wall portions 75 and 76 are connected together with hopper flanges 83 and nuts and bolts 84.

The rotor shaft 14 has first and second end portions 87 and 88 extending outwardly from adjacent portions of the end walls 81 and 82, and 101 and 102 respectively, and carrying first and second drive pulleys 91 and 92 respectively. First and second motors 93 and 94 have drive pulleys cooperating through first and second drive belts 95 and 96 to drive the drive pulleys 91 and 92 as shown. Thus, the rotor shaft 14 is driven from both ends, thus reducing asymmetrical loads on the shaft and bearings thereof.

Figure 5:
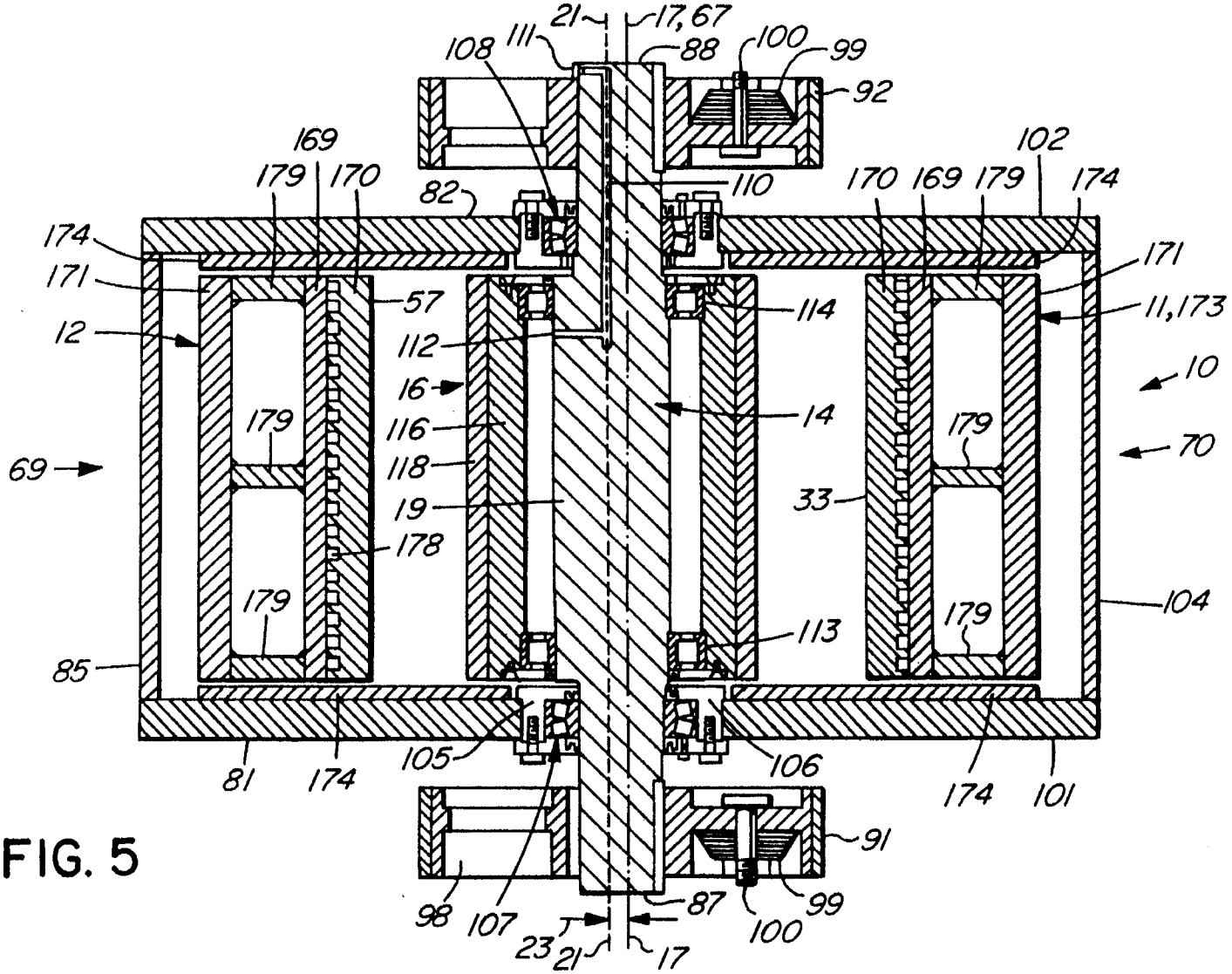
FIG. 5 is a simplified fragmented cross section on line 5—5 of FIG. 2.

In FIG. 2, the pulley 91 is shown as having five circular lightening openings, severally 98, and a counterweight 99 which are disposed circumferentially symmetrically about the axis 17 of the shaft 14. The counterweight 99 comprises a stack of counterweight discs which are secured with a nut and bolt 100 and serve as counterbalance weights for the rotor 16 which has the lobe displaced on the side of the axis 17 directly opposite to the counterweight 99. As best seen in FIG. 5, counterweight discs can be subtracted from the stack as needed to compensate for wear of the rotor as this occurs. As also seen in FIG. 5, the pulley 92 has a similar counterweight 99 with a similar stack of counterweight discs. Thus, the shaft 14 is counterbalanced along its length to provide accurate dynamic balancing of the shaft, permitting operation of the apparatus with negligible vibration at relatively high speeds, which is in contrast to the crushing apparatus of the prior art known to the inventor.

Referring to FIG. 5, the first end portion 87 of the shaft 14 has a first shaft bearing assembly 107 which comprises undesignated roller bearings, races, seals and housings etc., as is common practice. This bearing assembly cooperates with peripheries of complementary semi-circular recesses 105 and 106 in adjacent edges of the end walls 81 and 101 respectively which are adjacent the axial plane 67, which plane contains the shaft axis 17. Similarly, a second bearing assembly 108 cooperates with similar complementary undesignated recesses in adjacent edges of the end walls 82 and 102 respectively. Clearly, the bearing assemblies are concentric with the shaft axis 17 and serve as rotor shaft mounting means cooperating with the end walls to mount or journal the shaft for rotation with respect to the support housing. The lobe axis 21 is shown displaced laterally from the shaft axis 17, and a lubricating passage 110 extends within the shaft generally along a portion of the axis 21 from a lubricating inlet 111 adjacent the end portion 88 to a lubricating outlet 112 within the rotor.

The rotor 16 has an inner shell 116 carried on axially spaced apart first and second rotor bearings 113 and 114 mounted on the eccentric cylindrical lobe 19 of the shaft 14 to journal the rotor 16. Thus, it can be seen that the rotor 16 has an inner cylindrical surface journalled for rotation on the cylindrical lobe so that the rotor is mounted eccentrically relative to the shaft axis 17 and can rotate relative to the rotor shaft. The rotor has a one-piece outer shell 118 which is concentric with and a shrink-fit on the inner shell 116 so as to prevent relative movement therebetween. Alternatively, the outer shell can be made in several pieces and can be fitted on the inner shell using bolts and keys, as will be described with reference to FIGS. 20 and 21. The outer shell 118 provides a hard wearing surface for the rotor and is adapted to resist wear when crushing rocks, but can be replaced when worn. As it wears, adjustments to the stacks of discs of the counterweights 99 are needed to enable continual incremental balancing of the rotor. Undesignated end caps, labyrinth seals and other conventional means are provided to protect the first and second shaft bearing assemblies 107 and 108 and the first and second rotor bearings 113 and 114 from contamination with dust. When the rotor is journalled with respect to the rotor shaft, forces between material in the crushing chamber act on and cause rotation of the rotor with respect to the shaft, so that as the rotor shaft rotates and the rotor orbits, the rotor tends to be restrained from rotation with respect to material in the crushing chamber which tends to reduce wear of the rotor surface.

Figure 4:
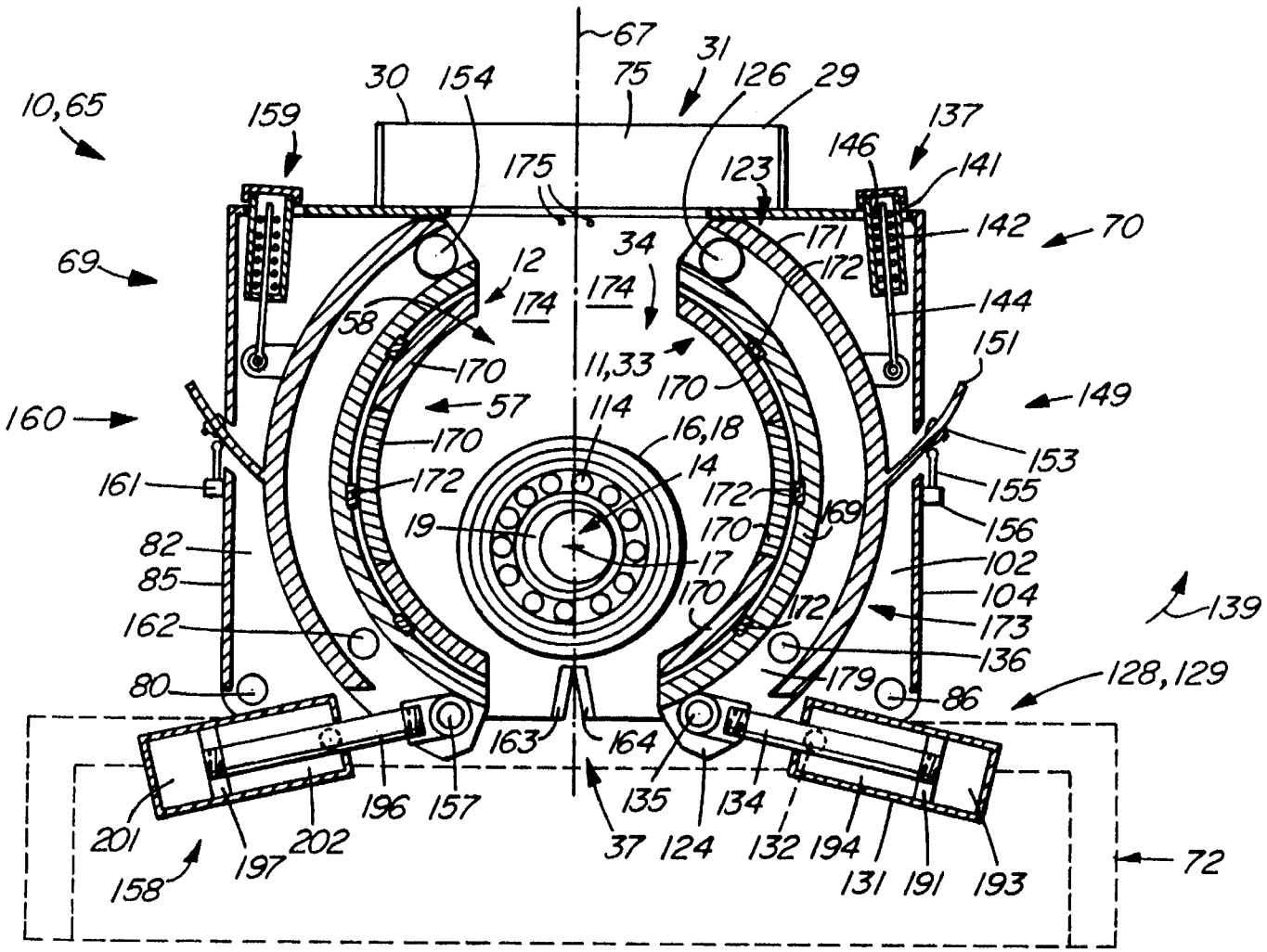
FIG. 4 is a simplified fragmented section on line 4—4 of FIG. 3.

Referring to FIG. 4, the first and second stators 11 and 12 are generally similar, and thus only the first stator 11 will be described in detail. The first stator 11 has first and second end portions 123 and 124, the first end portion being adjacent the inlet and hinged for rotation relative to the support housing by a first end hinge pin 126 cooperating with the end walls 101 and 102 of the right hand portion 70, the wall 101 being not shown in FIG. 4. To support the second end portion 124 of the stator, the apparatus has a first stator positioning means 128 for positioning the stator, the means 128 comprising a first stator hydraulic cylinder 129. The cylinder 129 has a cylinder body 131 which is trunnion mounted for rotation about two aligned trunnion mounts 132, best seen in FIG. 6, which cooperate with the chassis 72 for journalling the cylinder for limited rotation thereabouts. The cylinder 129 has a piston rod 134 having an outer end connected by a piston pin 135 to the second end portion 124 of the first stator to control location of the second end portion, and thus overall location of the stator. The cylinder 129 is supplied with fluid under pressure from a hydraulic circuit, to be described with reference to FIG. 12. The stator 11 has a locking opening 136 which can be aligned with aligned connecting pin openings 140, one being shown in FIG. 2, in the sidewalls 101 and 102 of the right hand portion 70 when the cylinder 129 is fully retracted. The aligned pin openings are critically located with respect to the cylinder 129 and the trunnion mount 132 for purposes to be described with reference to FIG. 7.

The first stator positioning means 128 cooperates with a first stator sensing means 149 for sensing when the stator 11 attains a pre-determined operating position of the stator with respect to the housing as follows. The means 149 comprises a curved sensor arm 151 extending from a rear portion of the stator on an arc centred on the hinge pin 126. The arm 151 carries a cam lobe 153 which cooperates with a cam follower 155 of a first sensor electrical switch 156 as will be described with reference to FIG. 13. As shown, the lobe 153 is just contacting the follower 155 and the switch 156 is open to prevent electricity flow therethrough, which is a normal operating condition of the apparatus. Relative location of the lobe 153 on the arm 151 and the follower 155 is critical as it determines the normal operating position of the stator. Position of the lobe 153 is adjustable on the arm 151 to permit re-positioning of the normal operating position of the stator. In effect, the lobe 153 and cam follower 155 serve as the stator sensing means for sensing position of the stator, and cooperate with the stator and housing and the stator positioning means 128 as will be described. It will be shown that the switch 156 functions as a limit switch and serves as a signalling means cooperating with the stator sensing means and the stator positioning means and the housing.

A resilient stator retracting means 137 for retracting the stator cooperates with the first stator 11 and applies a relatively light outwardly directed rotational force in direction of an arrow 139 to the stator to hold the stator away from the rotor. The means 137 comprises a tube 141 connected to the housing portion 70 and containing a compression spring 142, and a rod 144 extending through the tube and having opposite ends cooperating with the spring and the stator. A nut and washer 146 cooperate with threads on the rod 144 to adjust force of the retracting means tending to move the stator outwardly. The spring has sufficient strength to raise the stator to avoid undesirable interference with the rotor, but the spring cannot resist force from the cylinder 129.

Figure 6:
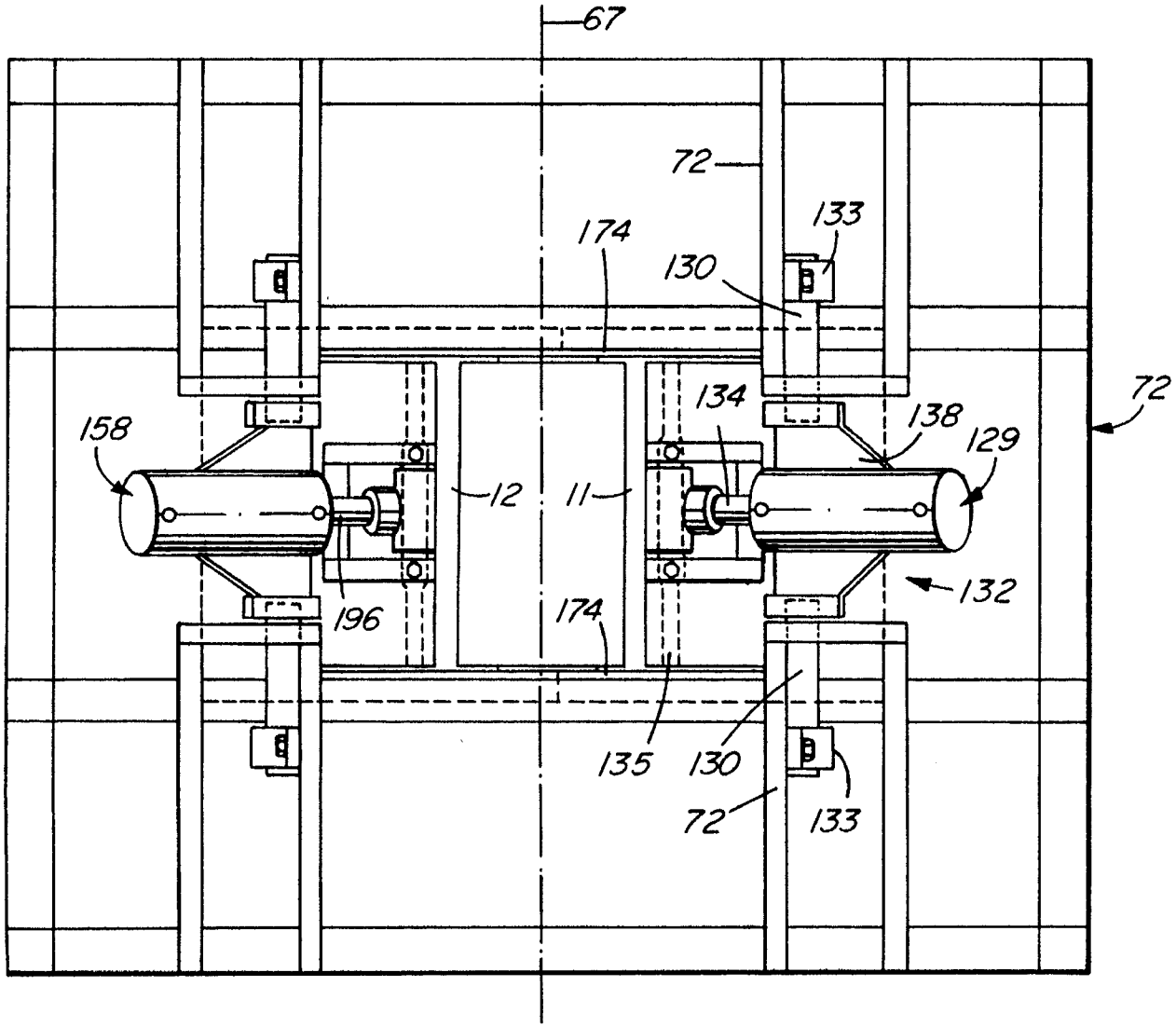
FIG. 6 is a simplified bottom plan of the apparatus of FIG. 2.

The second stator 12 is generally similar and cooperates with a corresponding first end hinge pin 154 and a piston pin 157 of a corresponding similar second stator cylinder 158. Similarly, a second stator retracting means 159, and a second stator sensing means 160 with a second sensor electrical switch 161, cooperate with the second stator 12 and corresponding structure as previously described for the first stator. The stator 12 has a locking opening 162 which is equivalent to the opening 136 of the stator 11 and is alignable with connecting pin openings 152, one only being shown in the wall 81 in FIG. 2, when the cylinder 158 is fully retracted. The cylinders 129 and 158 with respective trunnion mounting and reinforcements are also shown in FIG. 6 and these serve to yieldably mount or position the stators as will be described. The retracting means 137 and 159 and the sensing means 149 and 160 are also shown in FIG. 3.

Lower inner corners of the housing portions 69 and 70 are relieved at clearance portions 163 and 164 which are shallow curved radiused corners centred on the hinge pins 80 and 86 respectively for reasons to be described.

FIG. 7

The apparatus is shown with left hand and right hand housing portions 69 and 70 in full outline in raised positions, which is necessary for major servicing of the rotor and/or stators. The housing portions are shown in their normal, lowered operative position in broken outline at 69.1 and 70.1, which positions correspond to those in the previously described figures. The first and second stator hydraulic cylinders are shown fully retracted in broken outline positions at 129.1 and 158.1, and the stators are shown in similar fully retracted positions in broken outline and designated 11.1 and 12.1 respectively. In these retracted positions of the stators, the connecting pin openings 140 and 152 (FIG. 2) of the housings are aligned with the locking openings 136 and 162 of the respective stators 11 and 12. This alignment permits first and second connecting pins 165 and 166, shown in broken outline at 165.1 and 166.1 in retracted positions of the stators, to be fitted in the connecting pin openings 140 and 152 respectively in the housing and to pass through the aligned locking openings 136 and 162 of the stators, see FIG. 4. Thus, the pins 165 and 166 pass across the housing portions 69 and 70 and engage the appropriate aligned openings, so that the stators 11 and 12 are effectively locked between and to adjacent end walls of the respective housing portions. While hydraulic cylinders are shown, other equivalent linear actuators could be used.

To permit access inside the housing for servicing the rotor and/or stator, ends of the rotor shaft are first supported by a crane and the retaining nuts and bolts 77 and 84 (FIG. 2) of the flanges 71 and 83 of the housing portions are removed. From this position, actuation of the cylinders 129 and 158 (or other linear actuators) rotates the housing portions 69 and 70 about the hinge assemblies 79, 80 and 86 as shown by arrows 167 and 168 respectively. The crane lifts, the rotor shaft and associated bearing assemblies slowly upwardly simultaneously with the extension of the cylinders 129 and 158. Initial movement of the housing portions from the broken outline position is possible due to the curvature of the clearance portions 163 and 164.

Thus, in summary, the connecting pins 165 and 166 and the associated alignable locking and connecting pin openings in the stator and housing portions respectively provide releasable access connecting means to connect the outer end of the actuator to an adjacent portion of a separable end wall portion of the housing. When so connected, this permits the separable end wall portion of the housing to be moved, after removing the rotor shaft and bearing assemblies from the bearing assembly recesses in the housing. Thus, for moving one end wall only, actuation of the cylinder or linear actuator rotates the separable end wall portion to separate it from the remaining end wall portion and to move it generally laterally outwardly from the rotor shaft to expose a portion of the rotor shaft, the rotor and the stator for servicing as required.

It can be seen that one method of the invention is characterized by rotatably mounting the shaft carrying the rotor in the axially spaced apart end walls of the crushing chamber, hinging the spaced end walls 81 and 82 for rotation with respect to the chassis 72, and providing the end walls with releasable connecting means, i.e. the flanges 71 and 83 and the associated nuts and bolts 77 for releasably mounting the shaft. The method further includes yieldably restraining the second end portion 124 of the stator 11 with a linear actuator having an inner end hinged to a fixed portion of the housing, and an outer end, i.e. the rod 134, hinged to the stator 11. For servicing, the method is further characterized by disconnecting the releasable connecting means of the end walls and the shaft, and releasably connecting the stator to the end wall portion of the housing. This is followed by actuating the linear actuator so as to rotate the end wall portion about the respective hinge, so as to swing the end wall portion away from the rotor to expose the rotor and stator for servicing.

FIGS. 4 through 6, and 8 through 11

Figure 9:
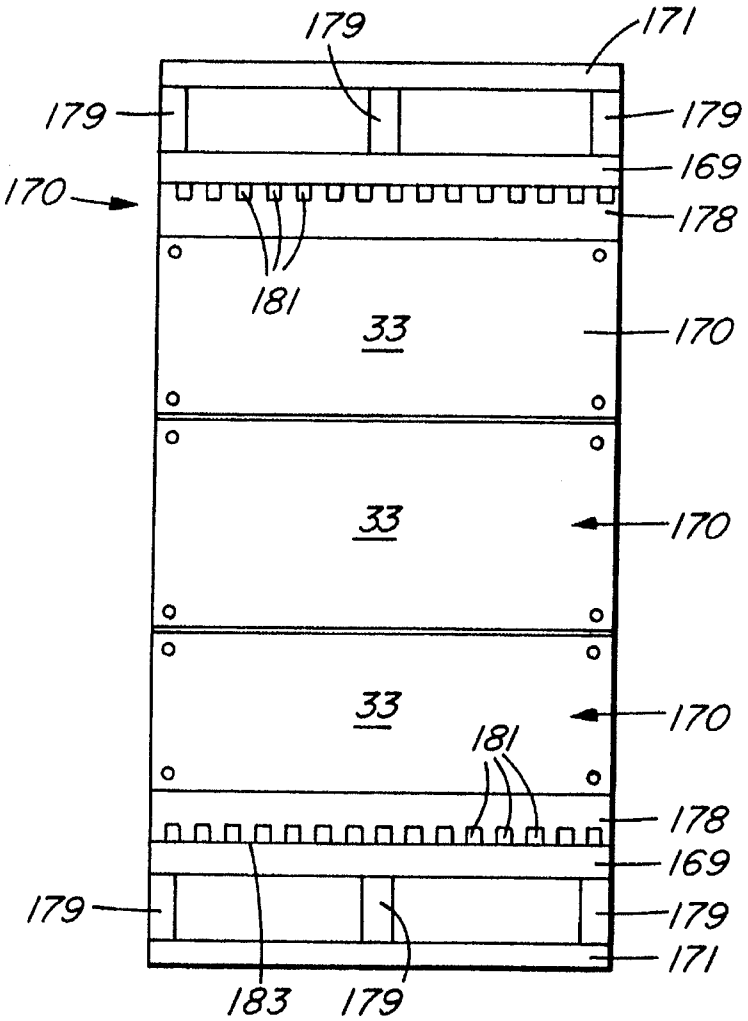
FIG. 9 is a plan view of an inner surface of a stator showing a stator wall comprising three stator liners.

Referring to FIGS. 4, 5, and 9, the first stator wall 33 is formed by a plurality of generally similar, partially cylindrically curved stator liners 170, in this instance three liners, which are secured to a stator body 173 by bolts to be described. The liners are made from a tough, wear-resisting material and can be replaced when excessively worn. The stator body 173 has generally concentrically curved inner and outer panels 169 and 171 held apart by and secured to three parallel similar curved beams 179 to ensure rigidity. A plurality of axially disposed keys 172 are located in complementary recesses in the inner panel 169 of the stator body 173 and the liners to prevent movement of the stator liners in the feed direction. Similar stator liners 170 are provided on the second stator 12 which structurally is a mirror image of the stator 11.

Figure 8:
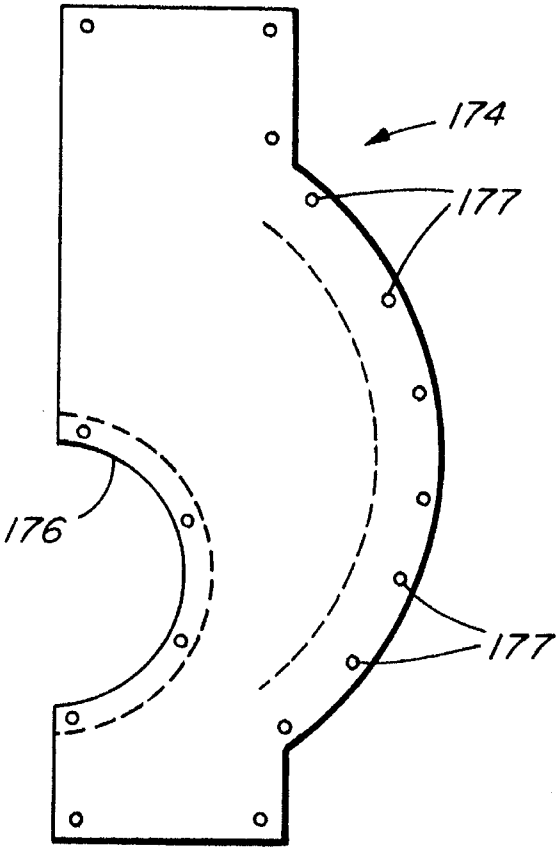
FIG. 8 is a plan view of a crushing chamber endwall liner.

End walls of the crushing chamber are provided with generally similar crushing chamber end wall liners 174, which are planar and have adjacent vertical edges aligned with the axial plane 67, and are releasably secured to end wall portions of the housing by bolts 175. A plan view of a crushing chamber end wall liner 174 is shown in FIG. 8, and is provided with a semi-circular recess 176 to receive the bearing assemblies for the rotor shaft, not shown, and coincide with edges of recesses corresponding to the recesses 105 and 106. Periphery of the liner 174 has a plurality of bolt openings 177 to receive the bolts 175. The liners 174 are also seen as end views thereof in FIG. 6, and are spaced closely to stators 11 to reduce ingress of fine gravel which could otherwise pass between the stators and the liners. The end wall liners 174 are made from tough, wear-resisting heavy plate material, and are replaceable when excessively worn. The liners can be made as separate pieces or segments to facilitate installation on large crushing apparatus.

Referring to FIG. 6, the trunnion mount 132 for the cylinder 129 comprises a pair of aligned trunnions or bearing shafts 130 which are secured to the cylinder body with reinforcing gussets and are journalled for rotation relative to the support chassis 72 in bearings 133. The pin 135 is connected to the second portion of the stator 11.

Figure 10:
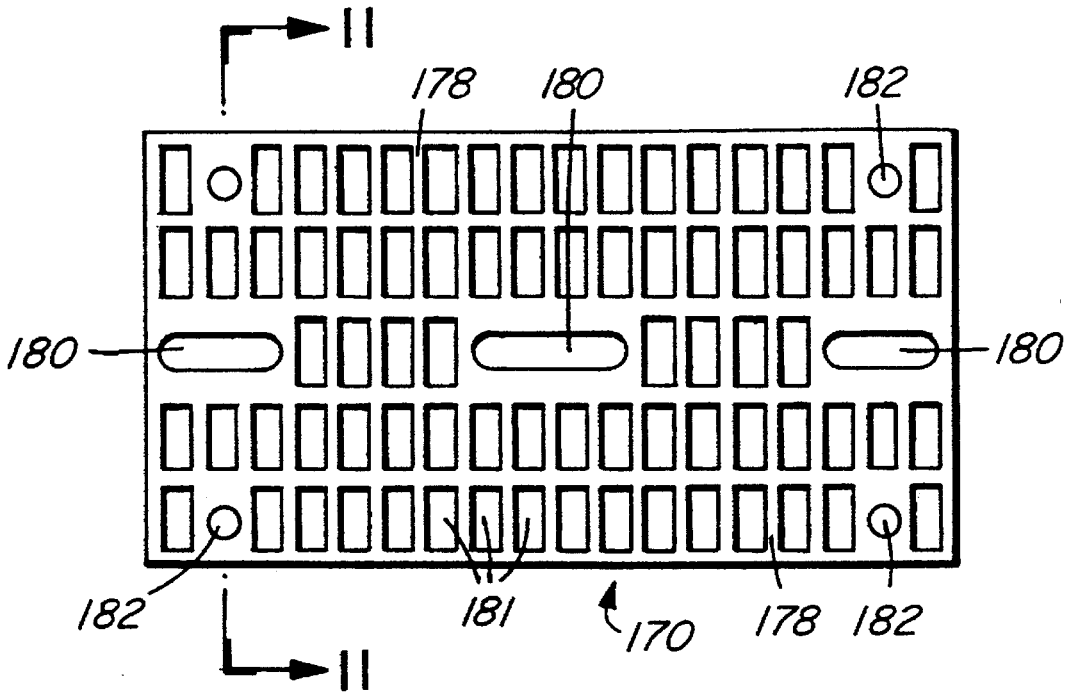
FIG. 10 is a plan of an outer surface of a stator liner of the stator wall.
Figure 11:
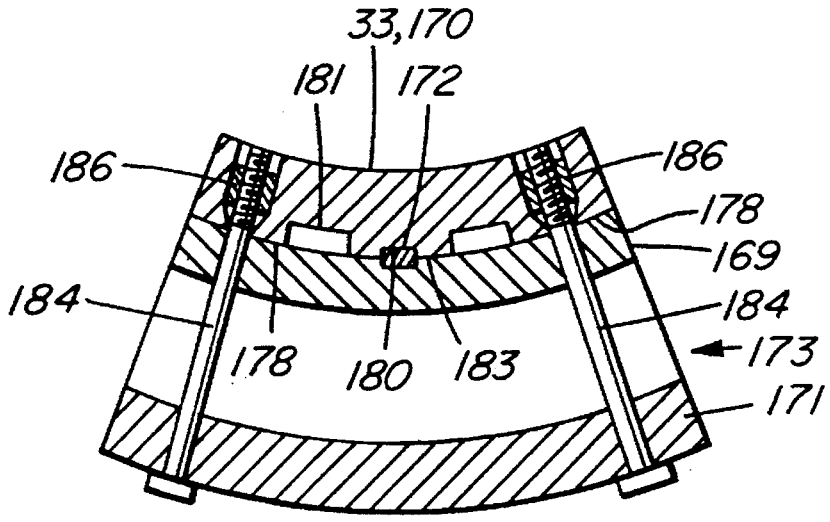
FIG. 11 is a simplified section on line 11—11 of FIG. 10, showing the stator liner secured to a stator body.

Referring mainly to FIGS. 9 through 11, a single stator liner 170 is generally rectangular when viewed in plan, and has a generally smooth front face to provide a portion of the first stator wall 33, FIG. 1, which contacts the material during crushing. The stator liner has a rear face provided with a rectangular grid of raised stiffeners 178 which define voids 181 therebetween and are integral with the stator liner and strengthen the liner. The rectangular grid has key ways 180 to receive the keys 172, shown in FIG. 4, and bolt openings 182 to receive bolts 184. The bolts extend generally radially from heads on an outer portion of the stator body 173 to threaded portions on an inner portion of the stator adjacent the wall 33, which portions receive nuts 186. Other means are envisaged for attaching liners to the stators.

Figure 12:
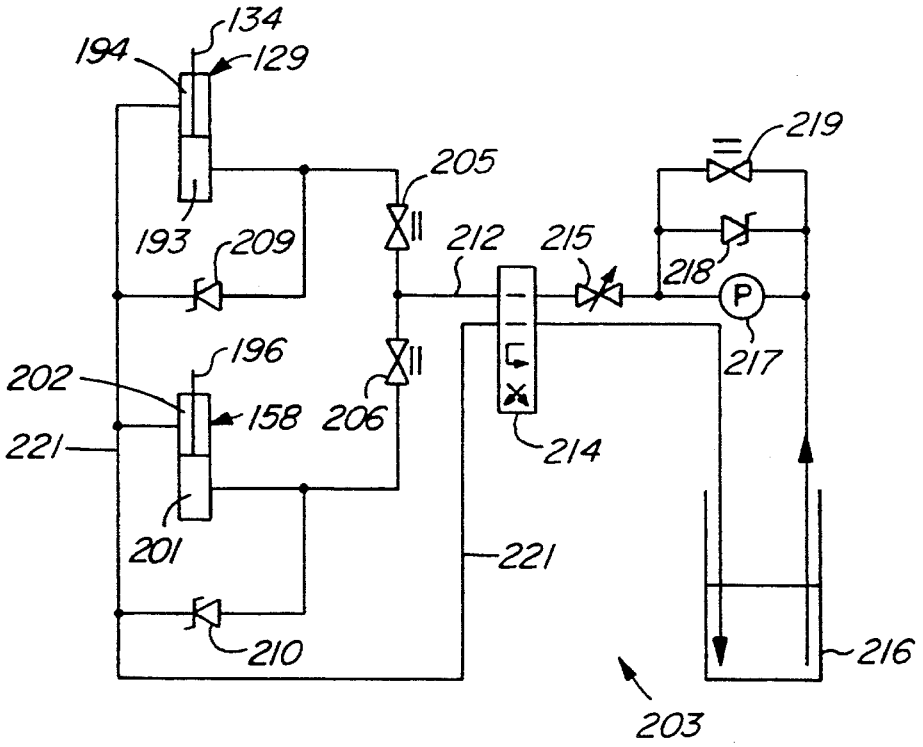
FIG. 12 is a simplified schematic of a hydraulic circuit associated with one embodiment of a stator positioning means of the invention.

FIGS. 4 and 12

Referring to FIG. 4, the hydraulic cylinder 129 has a piston 191 which divides the cylinder body 131 into first and second chambers 193 and 194 respectively on opposite sides of the piston. Similarly, the hydraulic cylinder 158 has a piston rod 196 and piston 197, the piston dividing the cylinder into corresponding first and second chambers 201 and 202 respectively.

Referring to FIG. 12, a hydraulic circuit 203 distributes fluid to the hydraulic stator cylinders 129 and 158 as follows. The first chambers 193 and 201 of the cylinders 129 and 158 respectively are connected by hydraulic conduits to first and second solenoid valves 205 and 206 and by branch conduits to first and second pressure relief valves 209 and 210 respectively. The solenoid valves 205 and 206 are normally spring closed and are connected through a common conduit 212 to a four-way, three-position main directional valve 214 which communicates through a variable or adjustable flow valve 215 with a sump 216 and a pump 217. The second chambers 194 and 202 of the cylinders 129 and 158 are connected by a common return conduit 221 which can also receive fluid when the relief valves 209 and 210 are open. Fluid in the conduit 221 passes through the valve 214 into the sump 216 when operating as above. A third pressure relief valve 218 and a fourth solenoid valve 219 are provided in respective conduits in parallel with the pump 217 to bypass the pump as will be described. The valve 214 is shown in a first position, in which the conduit 212 is a high pressure supply conduit which directs fluid from the pump into the first chambers 193 and 201 of the cylinders 129 and 158 to extend the piston rods 134 and 196 respectively so as to move the stators closer to the rotor, as best seen in FIG. 4.

When the valve 214 is shifted to a second or intermediate position, high pressure fluid from the pump merely circulates through the valve and is returned to the sump, thus providing a neutral position where the cylinders 129 and 158 are locked in position by a closed circuit, at least when pressure in the cylinders does not exceed normal operating pressure. The valve 214 can be shifted to a third position, in which direction of high pressure fluid is reversed and is fed to the second chambers 194 and 202 thus retracting the cylinders 129 and 158 while exhausting fluid from the first chambers to the sump, which can be used to assist in emptying the crushing chambers.

FIG. 13

An electrical circuit 226 is one example of a simple control circuit which electrically connects valve switches and the pump 217 (FIG. 12) to a power supply 228. The switches 156 and 161 (FIG. 4) which are controlled by the position of the stators are shown to be normally open, two-position, four-contact coupled switches. The electrical circuit also includes a first manual switch 231 which is in parallel with one of the pairs of contacts of the switch 156 to control flow through the solenoid valve 205 (FIG. 12). Similarly, the circuit 226 includes a second manual switch 232 which is in parallel with one of the pairs of contacts of the switch 161 to control flow through the solenoid valve 206 (FIG. 12). A third manual switch 233 controls current flow through the solenoid valve 219 (FIG. 12). A fourth manual switch 234 is in parallel with the remaining contacts of the switches 156 and 161 to control flow through the pump 217. The above is a simple circuit, and more complex circuits can be devised if required.

OPERATION

Initially, the electric switches 231, 232, 233, 234 and 235 are open and the main directional valve 214 is in the first position to supply high pressure fluid to the chambers 193 and 201. The first and second stator retracting means 137 and 159 (FIG. 4) hold the stators 11 and 12 in respective fully retracted positions, well clear of the rotor. When power is switched on, because the stator 11 is retracted, the lobe 153 is clear of the follower 155 of the switch 156, which in thus closed to conduct electricity. Similarly the switch 161 of the stator sensing means 160 of the second stator is also closed to conduct electricity. The pump is operating and receives power from the closed electric switches 156 and/or 161. Thus, both valves 205 and 206 are opened and conduct high pressure fluid from the pump 217 of FIGS. 12 and 13 to supply hydraulic fluid under pressure into the first chambers 193 and 201 of the cylinders 129 and 158 respectively. The piston rods 134 and 196 of the cylinders start to extend, moving the stators concurrently inwardly towards the rotor, and the lobe 153 towards the follower 155 in FIG. 4. When the lobe 153 contacts the follower 155, contacts of the switch 156 are opened, and current is stopped so that the valve 205 closes. If the stator 12 is in a corresponding position, the switch 161 is also opened and the valve 206 also closes. When the switches 156 and 161 are opened, because the switch 234 is also open, the pump 217 also stops. When the solenoid valves 205 and 206 are closed, the fluid in the first chambers of the stator cylinders is trapped and thus locates position of the stators. It can be seen that the switches 156 and 161 serves as signalling means cooperating with the stator sensing means, that is the cam lobe and cam follower, and the stator positioning means, that is the stator cylinder, to generate a signal to automatically position the stator at the pre-determined position with respect to the housing. When the solenoid valve 219 is opened, it recirculates pressurized fluid from the pump 217 so that pressure in the chambers 193 and 194 is reduced, relieving positioning forces on the stators to facilitate removal of an obstruction as will be described. During normal operation of the apparatus the valve 214 remains in the first position as shown, so as to provide pressurized fluid as required to the first chambers when the pump operates. When the valves 205 and 206 are closed, fluid in the cylinders 129 and 158 is locked, unless the relief valves 209 and 210 are opened as a result of an obstruction in the crushing chamber as will be described later.

The first and second motors 93 and 94 of FIGS. 3 rotate the rotor shaft 14 and the rotor 16 describes an orbital motion about the shaft axis 17. Referring to FIGS. 1 and 4, material to be crushed is admitted into the crushing chambers 34 and 58 through the inlet 31 and passes under gravity through the crushing chamber to the outlet 37, and is reduced in size as it passes through the crushing chambers as follows. It can be seen that moving the rotor in the orbital motion about the shaft axis 17 causes the rotor wall 18 to move cyclically and laterally with respect to the axis 17. The material feeds through the crushing chamber in the feed direction per arrows 39 and 60 (FIG. 1) which direction is generally perpendicular to the shaft axis 17, and spacing between the opposing walls varies cyclically and generally perpendicularly to the feed direction. As the opposing walls 18, 33 and 57 of the crushing chambers 34 and 58 are parallel to each other when viewed laterally of the shaft axis, i.e. looking along the feed direction, the material automatically distributes itself generally evenly along the rotor and between the end walls 81, 82, 101 and 102 of the housing.

Motion of the rotor with respect to the stators is generally similar to that of a cone crusher or a gyratory crusher, and clearly material is crushed cyclically in a manner similar to that of a cone crusher or gyratory crusher. Thus, as spacing between the rotor and stator decreases, material is crushed, and as the spacing increases the crushed material tends to fall down under gravity until it is restricted again by a decreasing spacing between the stator and rotor. The crushing is performed in an essentially continuous process which occurs cyclically on opposite sides of the rotor and consequently there is essentially no recovery time of the rotor as it is crushing essentially continuously, which contrasts with a jaw crusher. The rotor can be driven relatively fast when compared with a gyratory crusher, for example a rotor having a diameter of between 1.5 and 0.2 meters can be operated at speeds of between 600 and 1200 r.p.m. respectively The high speed of the rotor results in a corresponding high frequency of the variation of spacing between the stator and rotor, which increases rate of crushing. As the material becomes smaller, it falls incrementally downwardly through the crushing chamber until the crushed material is discharged from the crushing chambers through the outlet 37.

The present invention has a particular advantage which arises from the exact dynamic balancing that is possible with the present invention. Exact dynamic balancing permits operation of the crusher at the relatively high speeds as above, and it is known in the art that as the speed of the rotor increases, crushing efficiency increases and a phenomenon termed "multi-layer" crushing effectively occurs. In multi-layer crushing, there are several separate but contiguous layers of particles between the rotor and stator, i.e. space between the rotor and stator is several times greater than average size of particles of the material. Thus, the particles are mostly in contact with themselves, as opposed to being in contact with the rotor and stator. When crushing each other in this way, the shape of the particles becomes more cubical and less elongated or angular than in normal crushing, and distribution of particle size approaches ideal particle size distribution. In multi-layer crushing, the distance of the rotor and stator at the outlet does not determine directly size of the product. Thus, even if the size of the outlet is relatively large, small-sized particles are produced. The multi-layer crushing phenomenon increases productivity of the invention, and reduces the number of steps necessary to produce small gravel from relatively large rocks.

Because action of crushing in the present invention is generally similar to that of the cone crusher or gyratory crusher, it is anticipated that energy consumption will be similar to those types of crushers. However, a main difference between the present invention and the cone crusher or gyratory crusher relates to the direction of flow of crushable materials. In cone crushers and gyratory crushers, the crushed materials flow generally parallel to an axis of the eccentric or main shaft, which is disposed vertically and thus requires the crusher to be relatively tall. Because the vertical shaft is located centrally of the inlet of the gyratory crusher, upper shaft bearings, bearing supports and the shaft itself obstruct the inlet which reduces size of material that can be fed into the inlet.

In contrast, in the present invention, the shaft 14 is preferably disposed generally horizontally and the crushable material tends to flow vertically downwardly under gravity, which is usually generally perpendicularly to the axis 17 of the shaft. The shaft is disposed horizontally in the FIGS. 1 through 7, and while this is the preferred arrangement, the horizontal disposed shaft is not essential. The shaft is disposed well below the inlet, and thus does not obstruct the inlet and relatively large sized materials can be fed into the inlet, which contrasts with the relatively small size of material that is acceptable for the cone crusher and gyratory crusher. The maximum size of material that can be fed into the apparatus 10 is dependent on spacing between the stator and the rotor adjacent the inlet, as will be discussed with reference to FIG. 19.

The invention can also be compared and contrasted with a jaw crusher as follows. In a jaw crusher the crushable material flows at right angles to the eccentric shaft, similarly to the present invention, and the inlet of the jaw crusher is relatively unobstructed and can accept large size materials, also similarly to the present invention. However, as previously discussed, the crushing pattern of the jaw crusher differs considerably from that of the present invention and is characterized by high or "peak" crushing loads which aggravate wear of the apparatus, followed by recovery periods of no crushing, which reduces efficiency of the apparatus. In addition, frequency of operation of the jaw crusher is much lower than the present invention.

Thus, it can be seen that the present invention has the advantage of the jaw crusher of accepting large-sized material, and the advantages of the cone and gyratory crushers which provide essentially continuous crushing operation. It can therefore be seen that the present invention reduces the two main problems associated with the two main types of crushers, without incorporating some of their disadvantages.

Occasionally, a particularly hard piece of material can pass into the inlet and it can be too hard to be crushed by the apparatus. Such material could be a hardened steel tooth accidentally broken off from a lip of a digging bucket. The hard tooth would pass in the feed direction through the crushing chamber until it became wedged between the rotor and a stator, forming an obstruction. This can occur, for example, when the rotor is orbiting in a direction so as to reduce spacing between the first stator 11 and the rotor.

Figure 13:
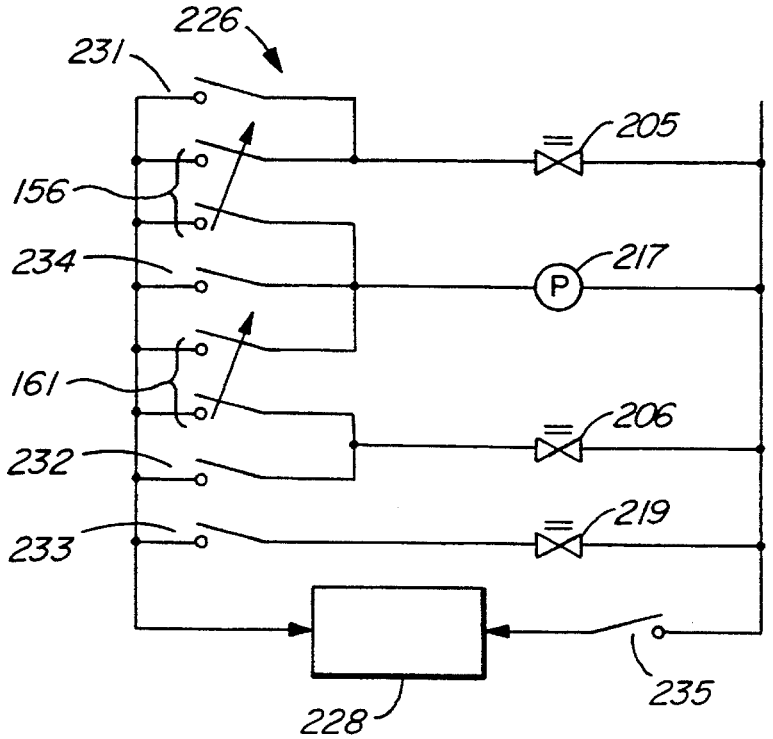
FIG. 13 is a simplified schematic of an electrical circuit associated with stator positioning means of the invention, showing cooperation with some components of the hydraulic circuit.

When the uncrushable material is wedged or jammed, further movement of the rotor towards the stator 11 increases pressure in the first chamber 193 of the cylinder 191 and when the pressure rises sufficiently to attain maximum operating or threshold pressure, the first pressure relief valve 209 will open and release fluid from the first chamber 193 to flow back into the sump 106 through the valve 214. This permits the stator 11 to move outwardly in direction of the arrow 139, FIG. 4, which permits the uncrushable material to fall a little, without pressure in the first chamber rising excessively, and also without imposing excessive forces on bearings of the shaft. As soon as the stator 11 moves outwardly, the electric switch 156, FIG. 13, is closed and this opens solenoid valve 205 and immediately starts operation of the hydraulic pump 217. Hydraulic fluid from the pump is then supplied to the first chamber 193 through the solenoid valve 205, FIG. 12, which starts to extend the rod 134 of the hydraulic cylinder 129, and commences to move the stator 11 to its original position before it was disturbed by the obstruction. However, the variable or adjustable valve 215 is normally set to restrict flow rate of hydraulic fluid and thus the extension of the cylinder is relatively slow, which ensures that the stator moves back to its original position relatively slowly, thus permitting the hard material to move downwardly until it becomes jammed again. As a result, upon each revolution of the shaft, if the hard material has not yet cleared the crushing chamber, the stator 11 barely moves inwardly, but instead tends to move outwardly in response to the cylinder repeatedly attaining the threshold pressure.

Eventually the piece of hard material escapes from the crushing chamber, after which the stator is restored gradually to its original position and at this position it is again hydraulically locked. Clearly, the valve 205 remains open passing fluid into the first chamber 193 until the cam lobe 153 engages the cam follow 155 and opens the switch 156, which in turn de-energises the solenoid valve 205 which automatically closes and prevents further flow of fluid to the first chamber 193, while locking the fluid in the chamber. It can be seen that the valve 215 and associated structure serve as delay means to delay return of the stator to the pre-determined position to enable the crushing chamber to clear of an obstruction causing the excessive force.

From the above it can be seen that the hydraulic stator cylinders, and the associated hydraulic circuit and electrical circuit serve as yieldable mounting means or yieldable stator positioning means for permitting yielding movement of the stator wall with respect to the support means when the stator wall is subjected to a generally laterally inclined force greater than a pre-determined threshold force. It is noted that the stator yields suddenly when the pressure is exceeded, and does not provide an increasing resilient resistance as the stator moves outwardly, in contrast to some prior art resiliently mounted stators in cone crushers and like devices. In such prior art devices provided with resiliently mounted stators, e.g. those using springs, it has been found that the uncrushable item becomes wedged more firmly as the yieldable device springs back rapidly to trap the uncrushable item. The hydraulic stator cylinders provide yieldable mounting means or yieldable stator positioning means comprising at least two extensible and retractable linear actuators which extend between the second end portions of the respective stators and the support means to provide yieldable mountings for each stator with respect to the support means. Each linear actuator has an inner end hinged to the support housing, and an outer connected to the respective stator to provide the said yielding.

If the operator wants to remove uncrushable material quickly from the first crushing chamber, the switch 233 can be manually closed, which actuates and opens the solenoid valve 219 which causes fluid to circulate back to the sump and bypass the conduit 212, with a corresponding rapid drop in pressure in the first chambers 193 and 201. Drop of pressure in the chambers 193 and 201 removes the hydraulic lock in the cylinders 129 and 158, and the cylinders are then moved passively by force in the crushing chamber and the first and second stator retracting means 137 and 159. Thus, fluid is displaced from opposite chambers of each cylinder as the stators to move outwardly to let the uncrushable material fall through the apparatus.

As previously described, for normal operation the valve 215 is adjusted to provide a relatively restricted flow of fluid from the pump into the first chambers 193 and 201 of the stator cylinders, to delay return of the stator to the pre-set position, to provide sufficient time for the hard material to clear the crushing chamber. When servicing the apparatus, it is sometimes desirable to move the stators quickly, either inwardly or outwardly, and for this the valve 215 is adjusted to provide a higher flow rate. Thus, depending on the setting of the main direction of the valve 214, with the valve 215 set to a high flow rate, the cylinder 129 and 158 can be made to extend or retract more quickly than would normally be the case.

ALTERNATIVES

The apparatus 10, and alternative apparatus to be described, are shown with the shaft axis 17 disposed horizontally, and feed direction disposed generally vertically, so that weight of the crushable material generates a feed force for feeding the material through the apparatus. This is a preferred disposition of the rotor shaft, however materials can be fed by forces other than gravity, thus the rotor shaft can be located vertically, or in any intermediate rotation. It has been found that when crushing dredge products taken from a body of water, the products can be fed hydraulically by a pump to be relatively independent of gravity, thus permitting the rotor shaft to be disposed at an angle other than horizontal.

In addition, the rotor shaft is shown journalled at two axially-spaced positions which is appropriate for a crushing relatively large and tough materials. However, for crushing small or relatively soft materials, the rotor shaft can be supported at one position so as to be cantilevered from that position.

For manufacturing convenience, the rotor is shown having the cylindrical rotor wall 18, and the stators have stator walls which are portions of cylinders. For certain applications it might be convenient to have a rotor of non-circular form, for example elliptical, or of some other geometry. Similarly, while the stators are shown to have partially cylindrical walls, the stators could also have non-partially cylindrical walls for particular applications. Clearly, projections and depressions, wave-like profiles or profiles with discontinuities can be provided for opposing walls of the crushing chamber. For some applications, an improved product can be obtained by providing corrugations on the walls of the stators and rotor, as will be described with reference to FIGS. 20 and 21.

Also, the apparatus 10 has one stator portion on each side of the rotor, which is adequate for many purposes. However, in some instances two or more stator portions can be provided on one or both sides of the rotor. Two examples of alternative stators are described with reference to FIG. 18.

FIG. 14

An alternative crushing apparatus 240 is generally similar to the apparatus 10 but has an asymmetrical stator arrangement in which a first crushing chamber 241 on one side of a rotor 242 accepts larger sized material than a second crushing chamber 244 on an opposite side of the rotor. The rotor is mounted for orbital motion about a shaft axis 243, and is essentially identical to the shaft 14 and rotor 16 of FIG. 1. The first crushing chamber is larger than the second chamber and is defined in part by a first stator 247 which has a first stator wall 248 centred on a first stator axis 250 spaced from the shaft axis 243 at a first axis spacing 251. The first crushing chamber 241 has a cross-sectional area defined in part by the rotor wall 252 and the first stator wall 248 which decreases in the feed direction through the first chamber. The first stator axis 250 is disposed within a radially aligned plane 253 extending toward a first inlet 254 as shown and is generally equivalent to the plane 45 of FIG. 1.

The apparatus has a second stator 256 having a second stator wall 258 centred on a second stator axis 260 disposed within the radially aligned plane 253 containing the shaft axis 243 and the first stator axis 250. Similarly to the first crushing chamber, cross-sectional area of the second crushing chamber is defined in part by the rotor wall and the second stator wall 258, and decreases in the feed direction through the second chamber. The second stator axis 260 is spaced from the shaft axis 243 by a second axis spacing 262 which is smaller than the first axis spacing 251. In this way, cross-sectional area of the second crushing chamber 244 at a specific location in the second crushing chamber, for example, at a diametrically aligned spacing at a location 264 is less than cross-sectional area of the first crushing chamber at a corresponding specific location, for example, a diametrically aligned spacing 265 at a mirror image location in the first crushing chamber.

The alternative apparatus 240 has a inlet hopper divider 268 which is disposed asymmetrically of the apparatus and on a side of the axis 253 remote from the first stator. The divider 268 provides the first inlet 254 and a second inlet 270 for the first and second crushing chambers 241 and 244 respectively, the second inlet being smaller than the first inlet. The first inlet is defined by the hopper divider 268 and a first hopper portion 271, and the second inlet is defined by the hopper divider and a second hopper portion 272. The first crushing chamber has a first discharge opening 275 to discharge intermediate-sized crushed material, and the second crushing chamber has a second discharge opening 276 to discharge relatively finely crushed material. A screen 279 is located below the discharge openings 275 and 276 and is adapted to pass relatively fine discharged material, most of which being discharged from the second discharge opening. The screen 279 retains the coarser intermediate sized material which is discharged mainly from the first discharge opening. A conveyor means 280, shown diagrammatically in broken outline, conveys relatively fine material that passes the screen 279 to storage or further processing. The intermediate size material is transported from the screen 279 on a return conveyor means 282 to the second inlet 270. This results in the intermediate-sized material from the first and second inlet discharge openings 275 and 276 being fed into the second inlet 270 for further processing to reduce it to a finer material which is sufficiently fine to pass through the screen 279. Thus, the return conveyor means 282 extends between the screen 279 and the second inlet 270 to convey the intermediate-sized crushed material from the first and second crushing chambers to pass through the second crushing chamber for further processing.

An alternative arrangement would be to provide a discharge divider 281, shown in broken outline, below the apparatus to separate intermediate-sized material discharged from the first discharge opening 275 from the finer material discharged from the second opening 276. In this alternative which is not shown in detail, the screen 279 receives materials discharged from the second discharge opening 276, whereas materials discharged from the first discharge opening 275 pass directly to the second inlet 270. Intermediate-sized material collected on the screen 279 is added to materials discharged from the first opening 275 and fed to the second inlet. This alternative arrangement provides an opportunity of re-shaping fine-sized material that can pass the screen 279 from the discharge opening 275 to provide a better shaped product.

Clearly, in yet another alternative, the screen 279 could be eliminated, and use of a hopper divider 268 and the discharge divider 281 permits two separate streams of material to be processed in a single apparatus with negligible mixing between the two streams, which would be appropriate in certain applications. Two separate conveyors, one for each discharge opening, would then be appropriate.

FIG. 15

The two previous embodiments disclose twin crushing chambers, i.e. there is a crushing chamber provided on each side of the rotor. This arrangement is preferred in some instances to provide an essentially continuous crushing action, to assist in distributing forces on the rotor bearings, and to use space of the apparatus relatively efficiently. For some instances, for example, when crushing exceptionally large material, or when a large reduction ratio is required for a crushing step, a single crushing chamber embodiment 285 is preferred. The embodiment 285 has a single stator 287, a rotor 289 and a hopper wall 290 which can be essentially identical to the first stator 247, the rotor 292 and the hopper divider 268 of FIG. 14. These elements cooperate to provide a single crushing chamber 292 extending between an inlet 293 and an outlet 294 thereof. Operation of the alternative embodiment 285 is essentially similar to previously described embodiments, and clearly tends to have a lower capacity as only one crushing chamber is exposed to the rotor. However, because this type of crusher can be operated at relatively high speeds, it has sufficient capacity to be used as a primary crusher. The single stator can be fitted with a linear actuator to provide a yieldable mounting means and the housing portion can be hinged and extended with the actuator to provide access for servicing as previously described.

Figure 16:
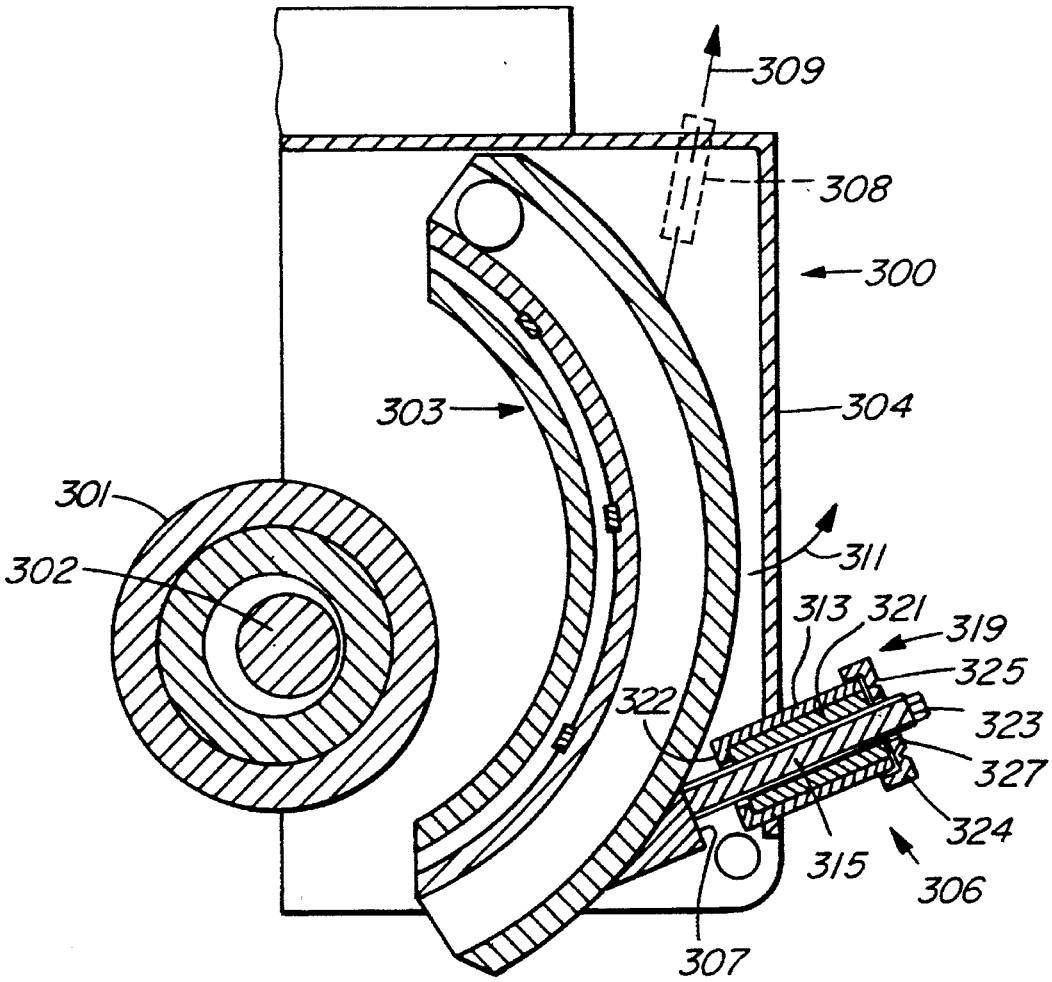
FIG. 16 is a simplified fragmented diagram showing a portion of the apparatus, generally similar to FIG. 4, showing an alternative mechanical type of stator positioning means.
Figure 17:
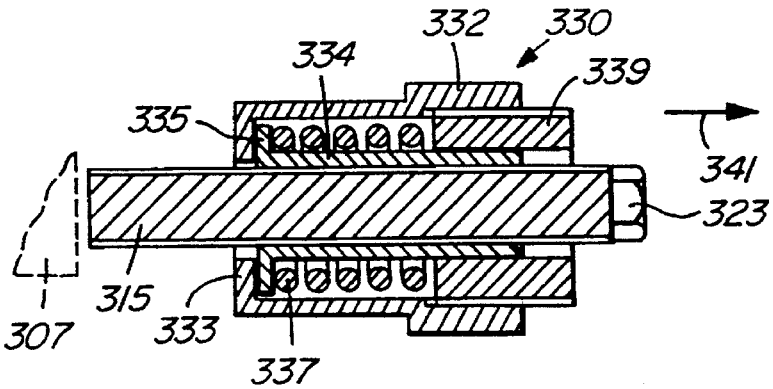
FIG. 17 is a simplified fragmented diagram, generally similar to a portion of FIG. 16, showing a second alternative mechanical type of stator positioning means.

FIGS. 16 and 17

In FIG. 16, a portion of an alternative crushing apparatus 300 is shown having a rotor 301 mounted eccentrically on a rotor shaft 302, at least one stator 303, a right hand housing portion 304 and other structure, not shown, which can be similar to previously described corresponding structure. The apparatus 300 has a first alternative stator positioning means 306, which is a substitute for the stator positioning means 128 of FIGS. 1 through 7 which is operated hydraulically and electrically. The stator positioning means 306 is a mechanical device, and thus the electrical and hydraulic circuits 203 and 226 of FIGS. 12 and 13 are eliminated.

The stator 303 has a stator positioning shoulder 307 cooperating with the positioning means 306 to provide a datum for accurate location of the stator, and which function generally equivalently to the cam lobe and cam follower 153 and 155 respectively of FIG. 4. The alternative apparatus 300 has a stator retracting means 308, shown schematically, which applies a relatively light force to the stator in direction of an arrow 309 generally similarly to the stator retracting means 137 and 159 of FIG. 4. The stator positioning means 306 resists the force from the retracting means and also force from material being crushed, until a maximum threshold force is attained at which time the stator positioning means 306 yields to permit the stator to move outwardly in direction of the arrow 311 in a manner somewhat similar to the positioning means 128 as previously described.

The positioning means 306 comprises a body 313 secured in the housing portion 304 and a plunger portion 315 which engages the shoulder 307 and is moveable axially in the body when a threshold force is attained. The stator positioning means 306 also comprises a frangible cap 319 which is threaded on an outer end of the body 313. The plunger portion 315 has a screw threaded outer circumference which engages a thread in a rigid sleeve 321 which is retained between an annular body flange 322 and the cap 319. The sleeve 321 locates the plunger portion 315 with respect to the body 313 so that the end of the plunger portion locates the shoulder 307 of the stator in the required position. The plunger portion 315 has a hexagonal head 323 to permit rotation, so as to vary relative position of the plunger portion and sleeve 321 as required. The cap 319 has a female screw threaded outer portion 324 to engage threads of the body 313. The cap also has an annular weakened portion 325 passing circumferentially around an inner portion of the threaded outer portion 324 at a location disposed radially outwardly of the body 313, and an inner ring portion 327 connected to the outer portion 324 by the weakened portion. The weakened portion can be a V-sectioned groove which reduces cross-sectional area of the cap 319 to ensure that the ring portion 327 breaks off when an excessive force is applied to the plunger portion 315 and then to the sleeve 321. Clearly, when the plunger portion 315 is subjected to an excessive outwards force e.g. due to some uncrushable object in the crushing chamber, the force is transmitted by the sleeve 321 onto the ring portion 327, which is sheared from the threaded portion 324 at the weakened portion 325. This shearing permits outward movement of the plunger portion 315, thus relieving force on the stator, which retracts outwardly under the action of the stator retractor means 308 and force in the crushing chamber. When the item that caused the excessive force is removed from the apparatus, a new frangible cap 319 is fitted to the positioning means 306 to re-position the plunger portion at the required position. The means 306 can be termed a frangible stator positioning means.

FIG. 17 shows an alternative resilient stator positioning means 330 which has the plunger portion 315 located within an alternative body 332 which is a substitute for the body 313. The body has an annular body flange 333 at an inner end to receive an inner end of the plunger portion 315 passing therethrough. An inner sleeve 334 is threaded onto the screw thread of the plunger portion 315 and has an inner flange 335 locating an end coil of a compression coil spring 337 positioned between the sleeve 334 and the body 332. An adjustable annular spring stop 339 is screw threaded onto the female thread on an outer portion of the body 332 and engages an outermost coil of the spring 337. Thus the spring is compressed between the inner flange 335 and the spring stop 339 to provide a resilient stop to resist outwards movement of the plunger portion 315 in direction of an arrow 341. It is noted that the plunger portion 315 is prevented from being urged fully inwardly by the spring by interference between the inner flange 335 and the body flange 333. Position of the plunger portion 315 with respect to the inner sleeve 334 and thus the flange 335 determines location of the inner end of plunger portion 315, which in turn sets the pre-determined position of the stator. Clearly, screwing the spring stop 339 inwardly towards the inner flange 335 increases compression force of the spring, thus providing a greater resistance to outwards movement of the stator, without changing the pre-determined position of the stator.

Clearly, the alternative mechanical stator positioning means 306 and 330 function more simply than the yieldable stator positioning means described previously and which require the more complex electrical and hydraulic circuit. In the frangible cap embodiment of FIG. 16, the cap fractures at the pre-determined threshold load, which could be relatively accurately determined. When the cap fractures, restraint on the stator is removed, and so the stator moves outwardly under the influence of the stator retracting means and material in the crushing chamber, permitting all material within the crushing chamber to fall outwardly therefrom. To re-establish operation of the apparatus, a new cap must be fitted and the stators repositioned manually. In contrast, the resilient stator positioning means of FIG. 17 yields resiliently progressively as a threshold force is exceeded, and this can present difficulties as previously described due to the uncrushable material forming an obstruction by becoming jammed between the stator and the rotor. If jamming occurs, the positioning means is dismantled to permit the spacer to move outwardly freely so that the uncrushable material can clear the chamber by falling under gravity from the outlet.

Thus, it can be seen that the yieldable mounting means extends between the second end portion and the support means to permit the said yielding movement of the stator wall with respect to the support means when the pre-determined threshold force is exceeded. While this is desirable to protect the apparatus, it is not essential to its normal operation, and is usually only provided in circumstances where uncrushable material might be expected. If a simplified apparatus is required, the yieldable mounting means can be eliminated, and the stators can be fixed with respect to the housing. It can be seen that the three different types of yieldable stator mounting means permit the stator wall of the crushing chamber to move yieldably with respect to the shaft axis when subjected to a crushing force above a pre-determined threshold force. This is attained by hinging a first end portion of the stator with respect to a fixed portion of the crushing chamber, and yieldably restraining a second end portion of the stator to permit the stator walls to move outwardly yieldably when the crushing force exceeds the pre-determined threshold force.

It can be seen that the frangible stator positioning means 317 of FIG. 16, and the resilient stator positioning 330 of FIG. 17 are alternative means to protect the stator and rotor from excessive damage, and are considerably simpler than the stator positioning means of the preferred embodiment, but have disadvantages as described above.

It can be seen that the stator positioning means 128 of FIGS. 1 through 13 discloses not only means to permit yielding of the stator from a pre-determined position when subjected to excessive force, but also means to return the stator to the pre-determined position when the excessive force is removed. This ability to return the stator to the pre-determined position is also found in the stator positioning means 330 of FIG. 17, using the mechanical spring. However, the means 128 responds more slowly than the means 330, and thus provides more time for the uncrushable item to clear the apparatus. Both of these types of arrangements can be referred to as a resilient mounting means for permitting resilient movement of the stator walls with respect to the support housing when the stator wall is subjected to a generally laterally inclined greater than a pre-determined threshold force. In addition, the resilient mounting means urges the stator wall to return to the pre-determined position when the excessive force is reduced. In general, this permits a faster return to normal operation than the yieldable means which fractures and then requires removal and replacement of fractured parts.

FIG. 18

Figure 18:
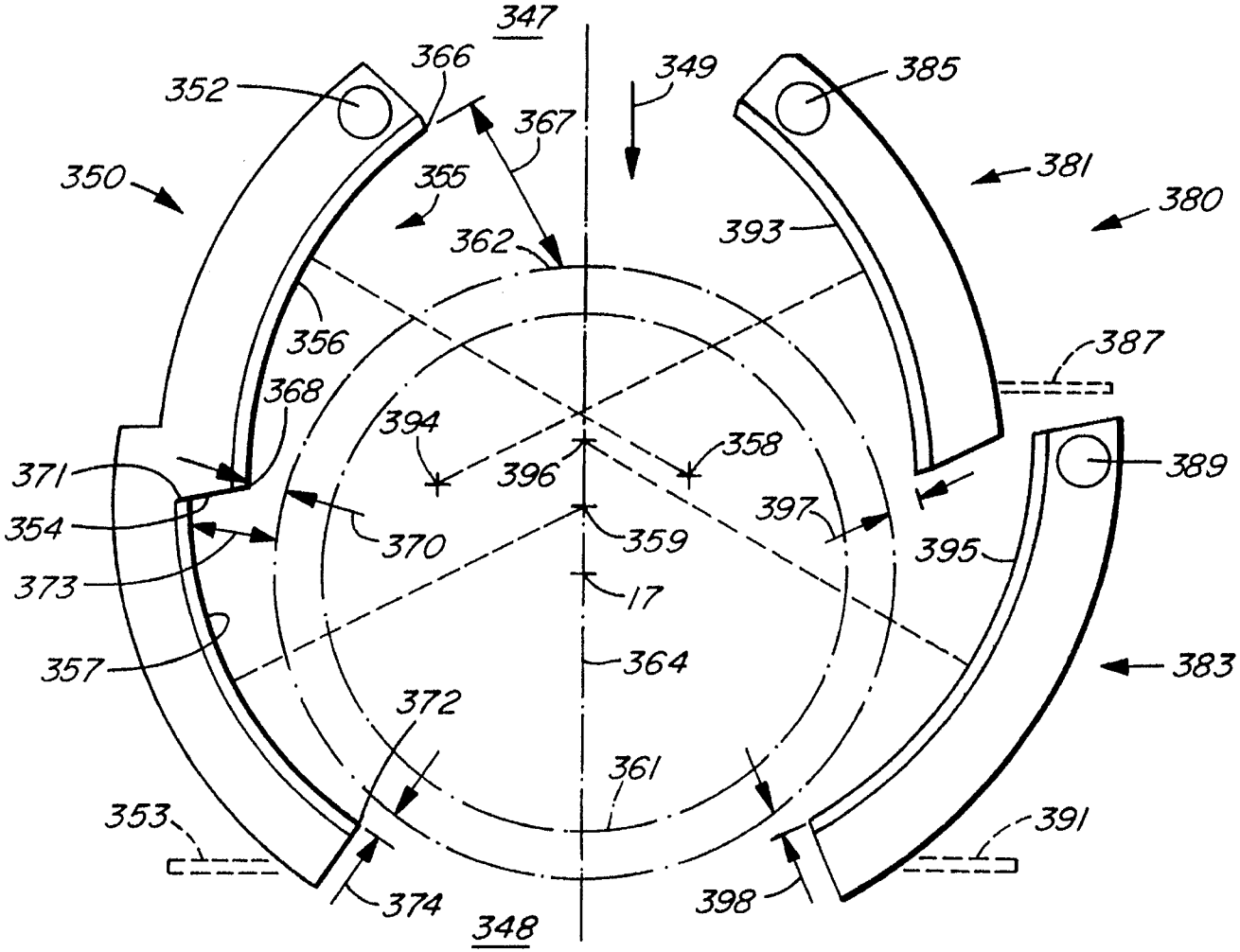
FIG. 18 is a simplified diagram, generally similar to FIG. 1, showing two alternative stators combined in one embodiment.

As previously stated, the stator wall can have a profile other than that of a circular arc, and FIG. 18 shows, in one figure, two alternative stators which are not normally combined in one crushing apparatus. Instead, a crushing apparatus normally has generally similar stators, on opposite sides of the rotor although they can be of different shapes and sizes. As before, the stators are mounted in an apparatus housing , not shown, having an inlet 347 and an outlet 348 defining feed direction as an arrow 349.

A first alternative stator is a stepped stator 350 having an upper portion hinged to the apparatus by a hinge pin 352, and a lower portion connected to a stator positioning means 353, shown diagrammatically, which positions the stator with respect to the housing, not shown. The stepped stator 350 has a stepped stator wall 355 having an upper inlet wall portion 356 adjacent the inlet, and a lower outlet wall portion 357 adjacent the outlet, so that the inlet wall portion is separated from the outlet wall portion by a step 354. The portions 356 and 357 are circular arcs centred on upper and lower stator axes 358 and 359 respectively. The apparatus also includes an eccentrically mounted rotor as previously described, in which inner and outer loci of the rotor wall (equivalent to 26 and 25 of FIG. 1) are shown in broken outline at 361 and 362 respectively. A radially aligned plane 364, equivalent to the radially aligned plane 45 of FIG. 1, passes through concentric centres of the loci 361 and 362 (on the axis 17), and the upper stator axis 358 is located on one side of the plane 364 remote from the stator 350, and the lower stator axis 359 is located on the plane 364.

The upper wall portion 356 has an upper corner 366 spaced from the locus 362 by an upper widest gap 367 and a lower corner 368 adjacent the step 354 and spaced from the locus 362 by an upper narrowest gap 370. The lower wall portion 357 has an upper corner 371 adjacent the step 354 and spaced from the locus 362 by an upper widest gap 373, and a lower corner 372 which is spaced from the locus 362 by a lower narrowest gap 374. Preferably, the lower widest gap 373 should be between approximately 1.5 and 2 times larger than the upper narrowest gap 370, so that the step 354 causes a significant increase in the cross-sectional area of crushing chamber for material passing downwardly through the crushing chamber. Because the lower outlet wall portion 357 is inclined to the horizontal at a shallower angle than the upper wall portion 356, material moving along the lower wall portion is slowed down by the said shallower angle. Also, the upper gap 370 is larger than or approximately equal to the lower gap 374 so that throughput of material through the lower gap 374 is always less than that through the upper gap 370. Both of the above factors causes an accumulation of crushed material in a lower portion of the crushing chamber. Thus, the accumulation of material builds up from the lower gap 374 upwardly toward the upper gap 370 and effectively ensures that multi-layer crushing occurs between the lower outlet wall portion 357 and the rotor and this improves final shape of the product. It can be seen that the space between the step 354 and the gap 372 serves as an accumulator to accumulate primary material that passed the gap 370 and is then subjected to multi-layer crushing before and during passing through the gap 374. Thus, the inlet and outlet wall portions are spaced with respect to the rotor such that flow of material past the inlet wall portion is controlled by flow of material past the outlet wall portion.

The step 354 is shown at a position approximately midway along the stepped stator 350, so that the upper inlet wall portion 356 has a similar arc length to the lower outlet wall portion 357. The step can be positioned at other locations, depending on requirements. For example, if the size of the feed material is relatively large, the gap 367 can be effectively increased by re-positioning the step 354 lower and more towards the corner 372, so as to increase length of the upper wall portion 356, and to reduce sliding angle in the upper wall portion. As is well know, maximum size of primary material to be fed into an apparatus is also limited by maximum sliding angle, and calculation of sliding angle is to be described with reference to FIG. 19.

The stepped wall 355 is particularly advantageous where a single crushing apparatus only is to be used to process raw material to finished material, and thus is required to handle a wide range of sizes of rock material to reduce them to a finished product size in one pass through the machine. The upper wall 356 serves as a primary crusher and the lower wall serves as a secondary crusher which improves shape of the relatively poor product which passes the upper gap 370.

A second alternative stator wall is shown as a multi-segmented stator 380 which comprises an upper inlet stator segment 381 and a lower stator segment 383. The upper stator segment is hinged to the apparatus by an upper hinge pin 385 and is controlled by an upper inlet stator positioning means 387. Similarly, the lower stator segment 383 has a lower hinge pin 389 and is controlled by a lower outlet stator positioning means 391. The upper stator segment 381 has an upper inlet wall portion 393 centred on an upper stator axis 394, and the lower stator segment 383 has a lower outlet stator wall portion 395 which is an arc centred on a lower stator axis 396 as shown. Similarly to the stepped stator wall on the opposite side of the rotor, lower portions of the upper and lower stator segments are positioned with respect to the locus 362 so that an upper narrowest gap 397 is generally equal to or larger than a lower narrowest gap 398, so that flow of material through the gap 397 is controlled by a flow of material through the gap 398 in a manner similar to the stepped stator. Clearly, geometry of the stepped stator and the segmented stator is generally similar. Thus, similarly to the stepped stator, the lower stator segment 383 serves as an accumulator wall to hold primary material that passed the gap 397 as it is fed at a slower rate through the gap 398. Clearly, the multi-segmented stator 380 has more flexibility and adjustment capabilities than the stepped wall, but correspondingly is more costly as it requires additional structure and controls.

FIG. 19

Figure 19:
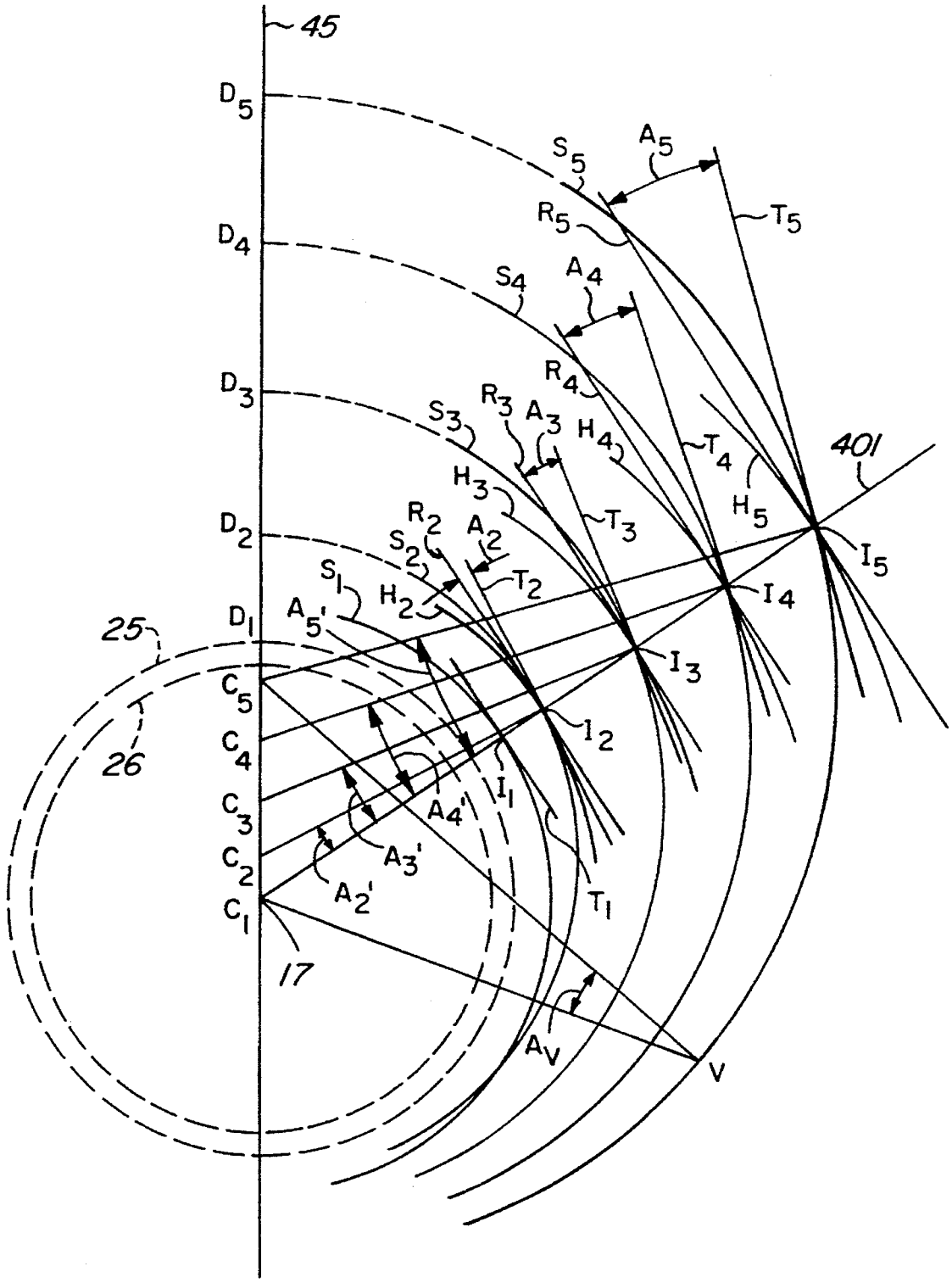
FIG. 19 is a simplified diagram showing some theoretical considerations relating to geometry of the apparatus.

FIG. 19 shows diagrammatically some theoretical considerations relating to geometry of the apparatus which should be considered when selecting shape, size and spacing of major components of the apparatus. Some components previously described with reference to FIG. 1 are designated with similar numerical references, for example, the rotor shaft axis 17, the outer and inner loci 25 and 26 (broken outline) of the rotor, and the radially aligned plane 45. The diagram shows positions of five alternative stator walls, corresponding to the first stator wall 33, but having radii of increasing sizes, the walls being designated $S_1$, $S_2$, $S_3$, $S_4$ and $S_5$. Each stator wall is a portion of a circular are centred on a stator axis, equivalent to the axis 41 but instead designated as centre "C", with a corresponding suffix. Thus the stator walls $S_1$, $S_2$, $S_3$, $S_4$ and $S_5$ are arcs centred on stator axes or centres designated $C_1$, $C_2$, $C_3$, $C_4$ and $C_5$ respectively. The series of stator walls $S_2$ through $S_5$ are disposed eccentrically with respect to the rotor axis 17, and all have the same reduction ratio.

It can be seen that $C_1$, which is the centre of stator wall $S_1$, is coincident with the shaft axis 17. Thus, the stator wall $S_1$ is concentric with the shaft axis, and this differs from the previously described embodiments. In the previously described embodiments, which are shown in FIG. 19 as stator walls $S_2$ through $S_5$, the stator walls are centred on stator centres $C_2$ through $C_5$ which are spaced above the shaft axis 17 in the radially aligned plane 45, i.e. the stator centres are disposed on a side of the shaft axis towards the inlet of the crushing chamber. In the previously described embodiments, this displacement of the stator centre away from the shaft axis towards the inlet provides a crushing chamber which has a cross-sectional area which decreases from the inlet to the outlet, i.e. in the feed direction. In contrast, the stator wall $S_1$, being concentric with the shaft axis, provides a crushing chamber of essentially constant cross-sectional area from the inlet to the outlet when based on the loci 25 or 26 of the rotor. While the rotor is orbiting, the wall of the rotor oscillates continuously and at a relatively high frequency between the outer and inner loci 25 and 26. At any instant, the crushing chamber as defined by the rotor and stator $S_1$, has an effective constant cross-sectional area extending from the inlet to the outlet. This alternative mainly uses the multi-layer crushing phenomenon to produce large quantities of relatively finely crushed products of good shape, for examples products of less than two centimeters in diameter. As previously stated, product size is much less than the gap between the rotor and the stator at the outlet, and preferably the stroke of the rotor, that is the eccentricity, should be larger than other embodiments in which the stator centre is displaced from the rotor centre.

The arcs of the remaining stator walls $S_2$ through $S_5$ are projected circumferentially to meet the radially aligned plane 45 at corresponding points $D_2$ through $D_5$. The outer locus 25 of the rotor intersects the plane 45 at point $D_1$. In the following equation, the expression "$C_1$ $C_2$" represents straight line distance between the point $C_1$ and point $C_2$, "$D_1$ $D_2$" represents straight line distance between the points $D_1$ and $D_2$ and similar designations represent spaces between corresponding remaining points.

By geometry it is found that:

$$\frac{D_1D_2}{C_1C_2}=\frac{D_1D_3}{C_1C_3}=\frac{D_1D_4}{C_1C_4}=\frac{D_1D_5}{C_1C_5}$$

Any radial line 401 passing through the shaft axis 17, i.e. $C_1$, intersects the arc $S_1$ as a radius at $I_1$, and thus intersects a corresponding tangent $T_1$ to the arc $S_1$ at 90 degrees. The remaining arcs $S_2$–$S_5$ intersect the line 401 at intersections $I_2$–$I_5$ and have corresponding tangents $T_2$–$T_5$, all tangents being shown as short straight lines. By geometry, an undesignated angle between the radial line $C_2$ $I_2$, and the tangent $T_2$ is 90 degrees. Similarly, undesignated angles between the radial lines and tangents $C_3$ $I_3$ and $T_3$; $C_4$ $I_4$ and $T_4$; and $C_5$ $I_5$ and $T_5$; are 90 degrees. Due to the eccentricity of the arcs $S_2$–$S_5$ with respect to the point $C_1$, the line 401 intersects the corresponding tangents $T_2$– $T_5$ at corresponding undesignated oblique angles. A plurality of arcs centred on $C_1$ are designated $H_2$–$H_5$ and have increasing radii equal to $C_1$ $I_2$, $C_1$ $I_3$, $C_1$ $I_4$, and $C_1$ $I_5$ respectively. The arcs $H_2$–$H_5$ have corresponding tangents $R_2$–$R_5$ respectively which are also shown as short straight lines. Clearly, the arcs $H_2$–$H_5$ and corresponding tangents $R_2$–$R_5$ also intersect the line 401 at the intersections $I_2$–$I_5$ respectively. Angles between the pairs of adjacent tangents $T_2$ and $R_2$, $T_3$ and $R_3$, $T_4$ and $R_4$, and $T_5$ and $R_5$ are designated $A_2$, $A_3$, $A_4$, and $A_5$ respectively. The angles $A_2$ through $A_5$ represent the "sliding angles" of crushable materials. The term "sliding angle" is usually used with respect to conventional crushing roll technology, and determination of upper limits of these angles is found by experiment and is critical to optimization of geometry of the apparatus.

It can be seen that an angle $A_2^1$ between the line 401 and the line $C_2$ $I_2$ is equal to angle $A_2$. Similarly, an angle $A_3^1$ between the line 401 and the line $C_3$ $I_3$ is equal to angle $A_3$. Similarly, angles $A_4^1$ and $A_5^1$ between the line 401 and the line $C_4$ $I_4$, and between the line 401 and the line $C_5$ $I_5$, are equal to angles $A_4$ and $A_5$ respectively. From this it can be seen that simple geometry permits easy determination of the sliding angle at any point on any of the stator walls as follows. For example, at a point V on the stator $S_5$, the sliding angle is equal $A_v$, which is the angle between line $VC_5$ and line $VC_1$.

From the above simple geometry, it can be seen that the sliding angle varies between the inlet and outlet, and is also a function of the degree of eccentricity of the stator wall, and the radius of the arc of the stator wall. For stator walls that are not circular arcs, or not eccentric with respect to the rotor axis, other considerations apply. For example, the stator wall $S_1$, which is concentric with the rotor axis $C_1$, has a sliding angle of 0 degree, which is obviously constant from the inlet to the outlet.

Inspection of FIG. 19 shows that, for a series of stators $S_2$–$S_5$ of increasing radii:

$$A_2<A_3<A_4<A_5$$

Thus, it can be seen that at a particular transverse location within the crushing chamber, that is at aligned intersections of a particular radial line extending from $C_1$, as radius of the wall increases, the sliding angle increases. This limits maximum size of a stator with respect to a given size of rotor and limits maximum size of feed material which can be accepted in the crushing chamber.

From the above, it can be seen in FIG. 18 that the stepped stator 350 and the multi-segmented stator 380, have inlet and outlet wall portions which are portions of circular arcs in which the radius of the are of the inlet wall portion is greater than the radius of the arc of the outlet wall portion. The sliding angle of the inlet wall portion 356 is within a reasonable range, and is usually less than about 25 degrees, and this permits crushing of primary material that is accepted within the gap 367. The sliding angle of the outlet lo wall portion 357 can be slightly larger than that of the inlet wall portion 356 because material that has passed the step 354 has an increased resistance to sliding. Clearly, in the stepped stator 350 relative positions of the inlet and outlet wall portions are fixed relative to each other, whereas in the multi-segmented stator 380, relative positions of the segments are controllable independently of each other.

The method of the invention using either of the stators 350 or 380 differ somewhat from the previously described method. In these two alternatives, while feeding material through the crushing chamber the material is subjected to a crushing chamber of decreasing cross-sectional area, followed by a relatively sudden increase in cross-sectional area which occurs as the material passes from the inlet stator wall portion to the outlet stator wall portion. This is again followed by a steady decrease in cross-sectional area towards the outlet.

As can be seen, the invention lends itself to many variables which can be adjusted to suit particular raw material characteristics, and required output. It can be seen that, for a given apparatus, it would be relatively easy to substitute stators of different radii, or a rotor shaft and rotor of different size or eccentricity so as to vary the parameters as discussed above, namely the radius of the stator walls S, radius of the rotor 16, and the eccentric spacing 23. These adjustments can be made without requiring major changes to remaining portions of the apparatus, which contrasts with some prior art apparatus.

Figure 20:
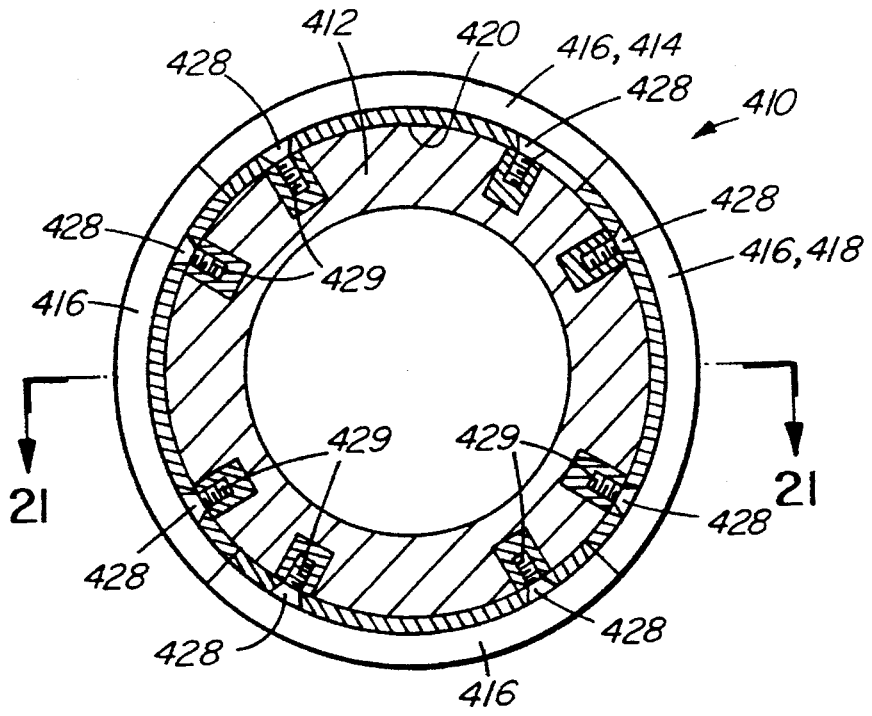
FIG. 20 is a simplified transverse section of an alternative rotor having an alternative rotor liner as seen on Line 20—20 of FIG. 21, showing some rotor liner connections, a rotor shaft being omitted.
Figure 21:
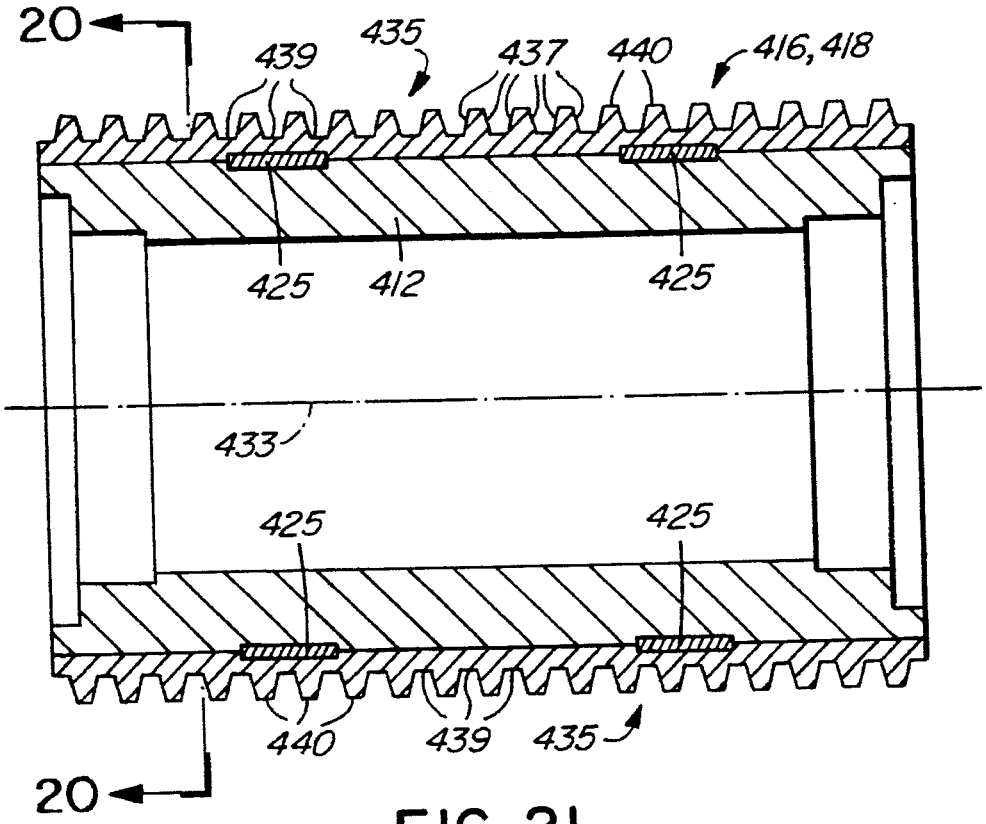
FIG. 21 is a simplified longitudinal section on Line 21—21 of FIG. 20 showing some rotor liner connectors, the rotor shaft being omitted.

FIGS. 20 and 21

Alternative rotor 410 has an inner shell 412 equivalent to the shell 116 of FIG. 5, and an alternative outer shell 414 which comprises a plurality of shell segments or liners, in this instance four similar segments 416 which each extend over a 90 degree quadrant.

The shell segment 416 has an outer wall 418, serving as a portion of the rotor wall, and is equivalent to the wall 18 of FIG. 1. The segment has a cylindrical inner wall 420 which is generally complementary to the inner shell 412 and has a plurality of keyways, each of which accepts a respective axially disposed key 425 which is received in a similar oppositely facing keyway in the inner shell 412 to prevent relative rotation between the shells. A plurality of radially aligned bolts 428 pass through complementary openings in the shell segment 416 and are received in threaded openings 429 in threaded inserts in the inner shell 412 to secure the segments and shell 412 together. When the shell segments 416 are worn, they can be easily removed from the inner shell by unscrewing the bolts 428, and replacing the worn segments with new segments. Consequently, such replacement is much simpler than when replacing the shrink-fitted outer shell 118 of FIG. 5. For exceptionally large rotors, clearly more than four shell segments can be provided, and if necessary these can be divided within radial planes so that two or more shell segments extend the full length of the rotor within a particular quadrant.

As previously stated, the rotor wall can have a variety of shapes, and it has been found that corrugations can assist in breaking up relatively large "plate-like" pieces of material. Referring to FIG. 21, the outer wall 418 has a plurality of corrugations 435 as shown. The corrugations are a series of wave-like depressions and ridges which extend circumferentially about an axis 433 of the rotor as shown. The corrugations have a cross section of a wave-like profile in which side walls 437 are relatively straight and inclined to each other, and spaced apart by cylindrical inner and outer annular surfaces 439 and 440 respectively. Clearly, other wave-like profiles can be devised and corrugations as described above can be applied to many of the rotors previously disclosed, and, in some applications, similar corrugations can be applied to stator liners to assist in breaking up plate-like material. In all instances, to reduce forces that might retard movement of the material through the apparatus, the corrugations have axes aligned with direction of feed of material through the apparatus, similarly to primary jaw crushers, in contrast with corrugations disposed normally to the feed direction as is sometimes found in roll crushers.

The corrugations provide sufficient stiffness for the shell 414 to resist crushing forces, and thus the inner wall 420 is cylindrical. However, if the corrugations 435 are omitted, the inner wall 420 would be provided with a rectangular grid of stiffeners (not shown), which can be similar to the grid of stiffeners 178 found on the inner wall of the stator liners of FIGS. 8–11.

What is claimed is:

1. A method of crushing material, the method comprising the steps of:

(a) admitting the material into a crushing chamber, (b) moving an eccentrically mounted rotor in an orbital motion about a shaft axis within the crushing chamber to provide a rotor wall which is disposed parallel to the shaft axis when viewed laterally of the axis and which moves cyclically and laterally with respect to the shaft axis as the rotor describes the orbital motion, the rotor being moved by rotatably mounting a shaft carrying the rotor in axially spaced apart housing end walls of the crushing chamber, each end wall comprising separable end wall portions, providing the end wall portions with releasable connecting means for releasably interconnecting the separable adjacent end wall portions and for mounting the shaft, and mounting two axially spaced apart end wall portions for limited hinged rotation with respect to a chassis, (c) spacing a stator laterally from the rotor to provide oppositely facing rotor and stator walls which are parallel to each other when viewed laterally of the axis and which define in part walls of the crushing chamber so that, when the rotor is moving, spacing between the opposing walls varies cyclically, the stator being supported by hinging a first end portion of the stator with respect to the hinged end wall portion, and yieldably restraining a second end portion of the stator with a linear actuator having an inner end hinged to the chassis, and an outer end hinged to the stator to permit the stator wall to move yieldably when the crushing force exceeds a pre-determined threshold force, (d) discharging crushed material from the crushing chamber, and (e) if servicing is required, after stopping the rotor, disconnecting the releasable connecting means of the end walls and the shaft to permit eventual separation thereof, and releasably connecting the stator to the hinged end wall of the housing, and actuating the linear actuator so as to rotate the end wall portions and the connected stator with respect to the chassis, so as to swing the end wall portions and the said stator away from the stator to permit access for servicing the rotor, the rotor shaft and stator.

2. A method as claimed in claim 1 further characterized by:

(a) feeding the material through the crushing chamber in a feed direction which is generally perpendicular to the shaft axis so that spacing between the opposing walls varies generally perpendicularly to the feed direction of the material.

3. A method as claimed in claim 2, further characterized by:

(a) while feeding material through the crushing chamber, subjecting the material to a crushing chamber of decreasing cross-sectional area, followed by subjecting the material to a relatively sudden increase in cross-sectional area of the crushing chamber, which is followed by subjecting the material to a crushing chamber of decreasing cross-sectional area.

4. A method as claimed in claim 3 in which:

(a) controlling flow of material from an inlet portion of the crushing chamber to an outlet portion thereof by restricting flow of material from the outlet portion.

5. A method as claimed in claim 3, further characterized by:

(a) accumulating material adjacent the increase in cross-sectional area of the crushing chamber, to provide multi-layer crushing.

6. A method as claimed in claim 1, further characterized by:

(a) permitting the stator wall of the crushing chamber to move yieldably with respect to the shaft axis from a pre-determined position when subjected to a crushing force above a pre-determined threshold force.

7. A method as claimed in claim 6, further characterized by:

(a) subsequent to the stator wall yielding to the said crushing force, automatically returning the stator wall to the pre-determined position.

8. A method as claimed in claim 6, further characterized by:

(a) delaying the return of the stator wall to the pre-determined position to enable the crushing chamber to clear of an obstruction causing the excessive force.

9. A method as claimed in claim 6, further characterized by:

(a) prior to permitting the stator wall to yield when exposed to a force above the pre-determined threshold force, restricting the stator wall against yielding with a frangible stator positioning means, and (b) permitting the stator wall to yield by fracturing the frangible stator positioning means when exposed to the pre-determined threshold load which then removes restriction of the stator, permitting the stator wall to move away from the rotor.

10. A method as claimed in claim 1, further characterized by:

(a) applying a relatively light retracting force to the stator tending to move the stator outwardly with respect to the rotor when the stator is unrestricted.

11. An apparatus for crushing material, the apparatus comprising:

(a) a support means having an inlet and an outlet to receive material to be crushed and to discharge crushed material respectively, the support means comprising a support housing having first and second housing end walls spaced axially apart, each housing end wall comprising two separable end wall portions, at least one separable end wall portion of each housing end wall being hinged for rotation about a respective housing hinge of a chassis of the support means to permit separation of the separable end wall portions;

(b) a powered rotor shaft mounted for rotation with respect to the support means about a shaft axis, and a rotor shaft mounting means cooperating with the first and second housing end walls to mount the rotor shaft for rotation relative to the support housing;

(c) a rotor mounted eccentrically on the shaft for orbital motion about the shaft axis, the rotor having a rotor wall which is parallel to the shaft axis when viewed laterally of the axis, and which moves cyclically and laterally with respect to the axis when the rotor describes the orbital motion;

(d) at least a first stator mounted in the support means, the stator having first and second end portions, the first end portion being hinged for rotation relative to the hinged separable end wall portions of the adjacent support housing, the first stator having a first stator wall spaced oppositely from the rotor wall and disposed parallel to the rotor wall when viewed laterally of the axis to define therewith opposing walls of a first crushing chamber located between the inlet and outlet of the housing, so that when the rotor is describing the orbital motion spacing between the opposing walls varies cyclically, (e) yieldable mounting means comprising an extensible and retractable linear actuator extending between the stator and the support means to provide a yieldable mounting for the stator with respect to the support means, the linear actuator having an inner end hinged to the chassis of the support housing and an outer end hinged to the second end portion of the stator, and (f) releasable access connecting means to releasably connect the stator to adjacent portions of the hinged separable end wall portions of the housing, so that when the access connecting means connect the stator to the hinged separable end wall portions, while removing the rotor shaft, actuation of the linear actuator rotates each hinged separable end wall portions to separate each hinged wall portion from the remaining end wall portions, and to move the stator and the separable end wall portions generally laterally outwardly from the rotor shaft, to permit access for servicing the rotor shaft, the rotor and the stator.

12. An apparatus as claimed in claim 1, further comprising:

(a) yieldable mounting means for permitting yielding movement of the stator wall away from the rotor with respect to the support means when the stator wall is subjected to a generally laterally inclined outwardly directed force greater than a pre-determined threshold force.

13. An apparatus as claimed in claim 12, in which:

(a) the stator has first and second end portions, the first end portion being hinged for rotation relative to the support means, and (b) the yieldable mounting means extends between the second end portion and the support means to permit the said yielding movement of the stator wall with respect to the support means when the pre-determined threshold force is exceeded.

14. An apparatus as claimed in claim 12, in which the yieldable mounting means comprises:

(a) a stator positioning means to position the stator at a pre-determined spacing from the rotor, the stator positioning means cooperating with the stator and the housing.

15. An apparatus as claimed in claim 14, in which the yieldable mounting means further comprises:

(a) stator sensing means for sensing position of the stator, the stator sensing means cooperating with the stator and the housing, and (b) signalling means cooperating with the stator sensing means and the stator positioning means to generate a signal to automatically position the stator at a required position with respect to the housing.

16. An apparatus as claimed in claim 15 in which the stator positioning means comprises:

(a) an extensible and retractable hydraulic actuator extending between the stator and the support means, and (b) hydraulic power means to provide a supply of pressurized hydraulic fluid to actuate the hydraulic actuator in response to the signals from the signalling means.

17. An apparatus as claimed in claim 16, in which:

(a) the stator sensing means comprises a cam and a cam follower located with respect to the stator and the support means, to generate a signal reflecting position of the stator with respect to the pre-determined position, and (b) the signalling means communicates the signal from the stator sensing means to control supply of pressurized hydraulic fluid to the actuator so that the actuator moves the stator wall inwardly towards the rotor until the stator attains the pre-determined position, at which time a signal is generated to lock the stator in the pre-determined position.

18. An apparatus as claimed in claim 17, further comprising:

(a) a high pressure relief valve which is exposed to hydraulic pressure in the actuator and is adapted to open when a pre-determined threshold pressure is exceeded, which pressure corresponds to the pre-determined threshold force, so as to permit the stator exposed to the excessive force to move away from the rotor to release the force.

19. An apparatus as claimed in claim 12, further comprising:

(a) a stator retracting means for retracting the stator away from the rotor to avoid interference therewith, the stator retracting means cooperating with the support means to apply an outwards force to the stator in a direction opposite to force applied by the yieldable mounting means, force from the yieldable mounting means being greater than force from the retracting means.

20. An apparatus as claimed in claim 12, in which the yieldable mounting means comprises:

(a) a resilient mounting means for permitting resilient movement of the stator wall with respect to the support means from a pre-determined position when the stator wall is subjected to a generally laterally inclined force greater than a pre-determined threshold force, the resilient mounting means urging the stator wall to return to the pre-determined position when the excessive force is reduced.

21. An apparatus as claimed in claim 20, further comprising:

(a) delay means to delay return of the stator to the pre-determined position to enable the crushing chamber to clear of an obstruction causing the excessive force.

22. An apparatus as claimed in claim 11, in which:

(a) the rotor wall is partially cylindrical, and (b) the stator wall is partially cylindrical.

23. An apparatus as claimed in claim 11, in which:

(a) the rotor shaft has an eccentric cylindrical lobe having a cylindrical lobe surface, the lobe surface being centred on a lobe axis disposed parallel to, but spaced laterally from, the shaft axis, and (b) the rotor has an inner cylindrical surface journalled for rotation on the cylindrical lobe so that the rotor is mounted eccentrically relative to the shaft axis and can rotate relative to the rotor shaft.

24. An apparatus as claimed in claim 11, in which:

(a) the first stator wall has an inlet wall portion adjacent the inlet of the apparatus, and an outlet wall portion adjacent the outlet of the apparatus, and (b) the wall portions are spaced with respect to the rotor to provide an accumulator to accumulate crushed material adjacent the outlet wall portion, such that flow of crushed material past the inlet wall portion is controlled by flow of material past the outlet wall portion.

25. An apparatus as claimed in claim 24, in which:

(a) the first stator wall is stepped so that the inlet wall portion is separated from the outlet wall portion by a step, and (b) the inlet and outlet wall portions have respective lower corners spaced from adjacent portions of the rotor wall by respective narrowest gaps, in which the narrowest gap for the inlet wall portion is equal to or greater than the narrowest gap for the outlet wall portion.

26. An apparatus as claimed in claim 24, in which (a) the first stator has multiple segments in which the inlet wall portion is on an inlet stator segment, and the outlet wall portion is on an outlet stator segment, and (b) relative positions of the stator segments are controllable independently of each other.

27. An apparatus as claimed in claim 24, in which:

(a) the inlet and outlet wall portions are portions of circular arcs in which the radius of the arc of the inlet wall portion is greater than radius of the arc of the outlet wall portion.

28. An apparatus as claimed in claim 11, in which:

(a) the said walls of the first crushing chamber define in part a first feed direction of the material passing through the crushing chamber from the inlet to the outlet, and the first feed direction is generally perpendicular to the shaft axis.

29. An apparatus as claimed in claim 28, in which:

(a) the rotor wall is cylindrical and centred on a lobe axis disposed parallel to but spaced laterally from the shaft axis at an eccentric spacing, and (b) the first stator wall is partially cylindrical and centred on a first stator axis spaced from the shaft axis at a first axis spacing towards the inlet and within a radially aligned plane of the shaft axis, the eccentric spacing being less than the first axis spacing, so that cross sectional area of the crushing chamber decreases in the feed direction.

30. An apparatus for crushing material, the apparatus comprising:

(a) a support means having an inlet and an outlet to receive material to be crushed and to discharge crushed material respectively; the support means comprising a support housing having first and second housing end walls spaced axially apart, each housing end wall comprising two separable end wall portions, each end wall portion being hinged for rotation about a respective housing hinge of a chassis of the support means;

(b) a powered rotor shaft mounted for rotation with respect to the support means about a shaft axis, and a rotor shaft mounting means cooperating with the first and second end walls to mount the rotor shaft for rotation relative to the support housing;

(c) a rotor mounted eccentrically on the shaft for orbital motion about the shaft axis, the rotor having a rotor wall which is parallel to the shaft axis when viewed laterally of the axis, and which moves cyclically and laterally with respect to the axis when the rotor describes the orbital motion;

(d) first and second stators mounted in the support means; the first stator having a first stator wall spaced oppositely from the rotor wall and disposed parallel to the rotor wall when viewed laterally of the axis to define therewith opposing walls of a first crushing chamber located between the inlet and outlet of the housing, the second stator being disposed on a side of the rotor remote from the first stator so that the rotor is partially enclosed by the first and second stators, the second stator having a second stator wall spaced oppositely from the rotor to define therewith opposing walls of a second crushing chamber located between the inlet and the outlet of the housing, the walls of the first and second crushing chambers defining in part first and second feed directions of the material passing through the apparatus from the inlet to the outlet thereof, the first and second feed directions being generally perpendicular to the shaft axis, so that when the rotor is describing the orbital motion, spacing between the opposing walls varies cyclically, each stator having first and second end portions, the first end portion of each stator being hinged for rotation relative to adjacent hinged separable end wall portions of the support housing, (e) yieldable mounting means comprising first and second extensible and retractable linear actuators extending between the second end portions of the first and second stators respectively and the support means to provide yieldable mountings for each stator with respect to the support means, each linear actuator having an inner end hinged to the chassis, and an outer end connected to the respective stator; and (f) releasable access connecting means to releasably connect the first and second stators to adjacent portions of the respective separable end wall portions of the housing, so that when the access connecting means connects the stators to the hinged separable end wall portions of the housing, while removing the rotor shaft, actuation of the linear actuators rotates the respective separable end wall portions to separate the end wall portions and to move the stators and the separable end wall portions generally laterally outwardly from the rotor shaft, to permit access for servicing of the rotor shaft, the rotor and the stators.

31. An apparatus as claimed in claim 30, in which:

(a) the first stator wall is centred on a first stator axis spaced from the shaft axis at a first axis spacing, and disposed within a radially aligned plane containing the shaft axis and extending generally towards the inlet, so that cross-sectional area of a first crushing chamber defined in part by the rotor wall and the first stator wall decreases in the feed direction, and (b) the second stator wall is centred on a second stator axis spaced from the shaft axis at a second axis spacing, and disposed within the said radially aligned plane containing the shaft axis, so that cross-sectional area of the second crushing chamber defined in part by the rotor wall and the second stator wall decreases in the feed direction through the second chamber, the second axis spacing being smaller than the first axis spacing, so that cross-sectional area of the second crushing chamber at a specific location in the second crushing chamber is less than cross-sectional area of the first crushing chamber at the corresponding specific location in the first crushing chamber.

32. An apparatus as claimed in claim 31, further characterized by:

(a) the first crushing chamber having a first inlet hopper to receive coarse material, and a first discharge opening to discharge intermediate crushed material, (b) the second crushing chamber having a second inlet hopper to receive the intermediate crushed material, and a second discharge opening to discharge fine crushed material, and (c) a conveyor means extending between the first discharge opening and the second inlet hopper to convey the intermediate crushed material from the first crushing chamber to the second crushing for further processing.

33. An apparatus for crushing material, the apparatus comprising:

(a) a support means having an inlet and an outlet to receive material to be crushed and to discharge crushed material respectively, (b) a powered rotor shaft mounted for rotation with respect to the support means about a shaft axis, (c) a rotor mounted eccentrically on the shaft for orbital motion about the shaft axis, the rotor having a rotor wall which is parallel to the shaft axis when viewed laterally of the axis, and which moves cyclically and laterally with respect to the axis when the rotor describes the orbital motion, (d) first and second stators mounted in the support means;

(i) the first stator having a first stator wall spaced oppositely from the rotor wall and disposed parallel to the rotor wall when viewed laterally of the axis to define therewith opposing walls of a first crushing chamber located between the inlet and outlet of the housing;

(ii) the second stator being disposed on a side of the rotor remote from the first stator, so that the rotor is partially enclosed by the first and second stators, the second stator having a stator wall spaced oppositely from the rotor to define therewith opposing walls of a second crushing chamber located between the inlet and the outlet of the housing;

(iii) the walls of the first and second crushing chambers defining in part first and second feed directions of the material passing through the apparatus from the inlet to the outlet thereof, the first and second feed directions being generally perpendicular to the shaft axis, so that when the rotor is describing the orbital motion spacing between the opposing walls varies cyclically;

(iv) the first stator wall being centred on a first stator axis spaced from the shaft axis at a first axis spacing and disposed within a radially aligned plane containing the shaft axis and extending generally towards the inlet, so that cross-sectional area of a first crushing chamber defined in part by the rotor wall and the first stator wall decreases in the feed direction; and (v) the second stator wall being centred on a second stator axis spaced from the shaft axis at a second axis spacing, and disposed within the said radially aligned plane containing the shaft axis, so that cross-sectional area of the second crushing chamber defined in part by the rotor wall and the second stator wall decreases in the feed direction through the second chamber, the second axis spacing being smaller than the first axis spacing, so that cross-sectional area of the second crushing chamber at a specific location in the second crushing chamber is less than cross-sectional area of the first crushing chamber at the corresponding specific location in the first crushing chamber, (e) first and second inlet hoppers communicating with the first and second crushing chambers respectively, the first inlet hopper being adapted to receive coarse material and the second inlet hopper being adapted to receive intermediate crushed material, the first crushing chamber having a first discharge opening to discharge intermediate crushed material, and the second crushing chamber having a second discharge opening to discharge fine crushed material, and (f) a conveyor extending between the first discharge opening and the second inlet hopper to convey the intermediate crushed material from the first crushing chamber to the second crushing chamber for further processing.

34. An apparatus for crushing material, the apparatus comprising:

(a) a support means having an inlet and an outlet to receive material to be crushed and to discharge crushed material respectively;

(b) a powered rotor shaft mounted for rotation with respect to the support means about a shaft axis;

(c) a rotor mounted eccentrically on the shaft for orbital motion about the shaft axis, the rotor having a rotor wall which is parallel to the shaft axis when viewed laterally of the axis, and which moves cyclically and laterally with respect to the axis when the rotor describes the orbital motion; and (d) at least a first stator mounted in the support means, the first stator having a first stator wall spaced oppositely from the rotor wall and disposed parallel to the rotor wall when viewed laterally of the axis to define therewith opposing walls of a first crushing chamber located between the inlet and outlet of the housing, so that when the rotor is describing the orbital motion spacing between the opposing walls varies cyclically; the first stator wall having an inlet wall portion adjacent the inlet of the apparatus and an outlet wall portion adjacent the outlet of the apparatus, the first stator wall being stepped so that the inlet wall portion is separated from the outlet wall portion by a step, and the inlet and outlet wall portions have respective lower corners spaced from adjacent portions of the rotor wall by respective narrowest gaps, in which the narrowest gap of the inlet wall portion is equal to or greater than the narrowest gap of the outlet wall portion to provide an accumulator to accumulate crushed material adjacent the outer wall portion, such that flow of material past the inlet wall portion is controlled by flow of material past the outlet wall portion.

35. An apparatus for crushing material, the apparatus comprising:

(a) a support means having an inlet and an outlet to receive material to be crushed and to discharge crushed material respectively;

(b) a powered rotor shaft mounted for rotation with respect to the support means about a shaft axis;

(c) a rotor mounted eccentrically on the shaft for orbital motion about the shaft axis, the rotor having a rotor wall which is parallel to the shaft axis when viewed laterally of the axis, and which moves cyclically and laterally with respect to the axis when the rotor describes the orbital motion; and (d) at least a first stator mounted in the support means, the first stator having a first stator wall spaced oppositely from the rotor wall and disposed parallel to the rotor wall when viewed laterally of the axis to define therewith opposing walls of a first crushing chamber located between the inlet and outlet of the housing, so that when the rotor is describing the orbital motion spacing between the opposing walls varies cyclically; the first stator wall having an inlet wall portion adjacent the inlet of the apparatus, and an outlet wall portion adjacent an outlet of the apparatus, the inlet and outlet wall portions being portions of circular arcs in which the radius of the arc of the inlet wall portion is greater than the radius of the arc of the outlet wall portion, the wall portions being spaced with respect to the rotor to provide an accumulator to accumulate crushed material adjacent the outlet wall portion, such that flow of crushed material past the inlet wall portion is controlled by flow of material past the outlet wall portion.

* * * * *